US007418841B2

(12) United States Patent
Yoon et al.

(10) Patent No.: US 7,418,841 B2
(45) **Date of Patent: *Sep. 2, 2008**

(54) FULL AUTOMATIC WASHING MACHINE AND METHOD FOR CONTROLLING THE SAME

(75) Inventors: Seong No Yoon, Changwon-shi (KR); In Geun Ahn, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/580,046

(22) Filed: Oct. 13, 2006

(65) Prior Publication Data

US 2007/0028399 A1 Feb. 8, 2007

Related U.S. Application Data

(63) Continuation of application No. 10/344,244, filed as application No. PCT/KR02/01112 on Jun. 12, 2002, now Pat. No. 7,171,715.

(30) Foreign Application Priority Data

| | | |
|---|---|---|
| Jun. 12, 2001 | (KR) | 10-2001-32864 |
| Dec. 29, 2001 | (KR) | 10-2001-88446 |
| Mar. 26, 2002 | (KR) | 10-2001-16504 |
| Mar. 27, 2002 | (KR) | 10-2001-16794 |
| Mar. 27, 2002 | (KR) | 10-2001-16795 |
| Mar. 27, 2002 | (KR) | 10-2001-16796 |
| Mar. 27, 2002 | (KR) | 10-2001-16797 |

(51) Int. Cl.
*D06F 37/30* (2006.01)

(52) U.S. Cl. ..... 68/12.24; 68/133

(58) Field of Classification Search ..... 68/133, 68/12.24
See application file for complete search history.

(56) References Cited

U.S. PATENT DOCUMENTS 1,499,742 A * 7/1924 Lamb ..... 192/148

(Continued)

FOREIGN PATENT DOCUMENTS

CN 1224784 A 7/1998

(Continued)

*Primary Examiner*—Frankie L Stinson
(74) *Attorney, Agent, or Firm*—McKenna Long & Aldridge LLP

(57) ABSTRACT

Full automatic washing machine, and method for controlling the same, the fall automatic washing machine including a spinning tub 2 movably fitted in an outer tub 1, a pulsator 3 rotatably fitted in the spinning tub 2 to be rotatable independent from the spinning tub 2, a spinning shaft 5 rotatably supported on a shaft bearing case 20 for transmission of a rotating power to the spinning tub 2, a washing shaft 4 for transmission of the rotating power to the pulsator 3, a BLDC motor 7 having a rotor 7*b* and a stator 7*a* for rotating the rotor 7*b* as power is applied to the stator 7*a*, and a clutch mechanism for switching a power transmission path of the BLDC motor 7 either to the washing shaft 4 or to the spinning shaft 5 in correspondence to a washing cycle, or a spinning cycle, thereby permitting noiseless, and stable switching of the rotation power within a short time when the rotating power is transmitted to the pulsator or the spinning tub from a driving-part having the stator and the rotor.

65 Claims, 28 Drawing Sheets

U.S. PATENT DOCUMENTS

| | | | | | |
|---|---|---|---|---|---|
| 1,507,416 | A | * | 9/1924 | Orr | 74/324 |
| 1,964,440 | A | * | 6/1934 | Patch | 68/133 |
| 2,019,564 | A | * | 11/1935 | Frantz et al. | 68/133 |
| 2,331,897 | A | | 10/1943 | Dyer | |
| 2,403,233 | A | * | 7/1946 | Patch | 74/75 |
| 2,462,657 | A | | 2/1949 | McNairy | |
| 2,656,702 | A | | 10/1953 | Chapin | |
| 2,768,533 | A | * | 10/1956 | Landwier | 210/360.1 |
| 2,869,699 | A | * | 1/1959 | Bochan | 192/48.1 |
| 2,969,665 | A | | 1/1961 | Desire | |
| 2,974,542 | A | * | 3/1961 | Session et al. | 74/665 K |
| 3,085,445 | A | * | 4/1963 | Fields | 474/19 |
| 4,218,899 | A | * | 8/1980 | Mason | 68/12.25 |
| 5,150,589 | A | | 9/1992 | Williams et al. | |
| 5,208,931 | A | | 5/1993 | Williams et al. | |
| 5,403,882 | A | | 4/1995 | Huggins | |
| 5,586,455 | A | | 12/1996 | Imai et al. | |
| 5,737,944 | A | | 4/1998 | Nishimura | |
| 5,778,703 | A | * | 7/1998 | Imai et al. | 68/12.02 |
| 5,884,507 | A | | 3/1999 | Lee et al. | |
| 5,887,458 | A | | 3/1999 | Bae | |
| 6,049,930 | A | | 4/2000 | Hisano et al. | |
| 6,060,851 | A | | 5/2000 | Imai et al. | |
| 6,148,646 | A | | 11/2000 | Koshiga et al. | |
| 6,176,108 | B1 | | 1/2001 | Bae et al. | |
| 6,194,894 | B1 | | 2/2001 | Apel et al. | |
| 6,202,451 | B1 | | 3/2001 | Park et al. | |
| 6,257,027 | B1 | | 7/2001 | Imai | |
| 6,318,133 | B1 | | 11/2001 | Koshiga et al. | |
| 6,332,343 | B1 | | 12/2001 | Koketsu et al. | |
| 6,354,115 | B1 | | 3/2002 | Zahn | |
| 6,470,714 | B2 | | 10/2002 | Koshiga et al. | |
| 6,546,762 | B2 | | 4/2003 | Koshiga et al. | |
| 2002/0166349 | A1 | | 11/2002 | Lim et al. | |
| 2003/0131636 | A1 | | 7/2003 | Lim et al. | |

FOREIGN PATENT DOCUMENTS

| | | | | |
|---|---|---|---|---|
| EP | 0 239 261 | A2 | | 3/1987 |
| JP | 60-188199 | | * | 9/1985 |
| JP | 6-218187 | | * | 8/1994 |
| JP | 10-314489 | | | 2/1998 |
| JP | 10-235077 | | | 8/1998 |
| JP | 11-239691 | | | 7/1999 |
| JP | 11-290578 | | * | 10/1999 |
| JP | 11-347289 | | | 12/1999 |
| JP | 2000-70588 | | | 3/2000 |
| JP | 2001-17783 | | | 1/2001 |
| JP | 2001-113088 | | | 4/2001 |
| JP | 2002-070588 | | | 3/2002 |
| KR | P0143223 | B1 | | 4/1998 |
| KR | 100244335 | B1 | | 11/1999 |

* cited by examiner

FULL AUTOMATIC WASHING MACHINE AND METHOD FOR CONTROLLING THE SAME

This application is a continuation application of U.S. patent application Ser. No. 10/344,244, filed Feb. 11, 2003 now U.S. Pat. No. 7,171,715, which claims priority to International Patent Application No. PCT/KR02/01112, filed on Jun. 12, 2002, all of which are hereby incorporated by reference, as if fully set forth herein.

I. TECHNICAL FIELD

The present invention relates to a full automatic washing machine, and more particularly, to a new driving mechanism, and washing and spinning methods thereof, in a full automatic washing machine, in which washing and rinsing are made by a slow pulsator, and spinning is made by fast spinning tub.

II. BACKGROUND ART

The washing machine, in general removing various dirt stuck to clothes, beddings, and the like by using softening action of detergent, friction caused by water circulation coming from rotation of the pulsator, and impact given to laundry by the pulsator, carries out washing after sensing amount and kind of the laundry by sensors, to make automatic setting of a washing method, and supplying water to proper level according to the amount and kind of the laundry.

In related art methods for driving a full automatic washing machine, there are a method in which a rotating power of a driving motor is transmitted either to a washing shaft, or a spinning shaft by putting a power transmission belt, a pulley, and the like in between, for rotating either the pulsator, or the spinning tub, and a method in which a washing and spinning tub is rotated at speeds different from each other in washing and spinning by means of speed control of a BLDC motor (Brushless DC motor).

In the meantime, recently a structure makes an appearance, in which, though the BLDC motor is employed, power transmission paths are controlled to be different in washing and spinning, such that the pulsator is rotated slowly in washing, and the pulsator and the spinning tub are rotated at a high speed simultaneously in spinning, an example of which is disclosed in Japanese Laid Open Patent No. H11-347289.

However, the type disclosed in Japanese Laid Open Patent No. H11-347289 shows an unstable operation, and produces much noise during tooth engagement of the driving mechanism, since a tooth engagement clutch mechanism is put into operation by a solenoid.

III. DISCLOSURE OF INVENTION

An object of the present invention, devised for solving the foregoing various problems, is to provide a full automatic washing machine having a driving mechanism in which a stable rotation power transmission from a driving part with a stator and a rotor to a pulsator, or a spinning tub is change-over controlled positively without noise, and within a short time period.

Another object of the present invention is to provide a control method which can release a seizure caused by an inserted coupling in various situations of after water supply, before progressing a main washing, at finish of washing, before progressing a main spinning, and the like in a full automatic washing machine having a new form of driving mechanism in which a stable rotation power transmission from a driving part with a stator and a rotor to a pulsator, or a spinning tub is change-over controlled positively without noise, and within a short time period.

To achieve the foregoing objects of the present invention according to a first aspect of the present invention, there is provided a full automatic washing machine including a spinning tub rotatably fitted to an inside of an outer tub, a pulsator fitted to an inside of the spinning tub rotatable independent from the spinning tub, a spinning shaft rotatably held in a shaft holding bearing case for transmission of a rotating power to the spinning tub, a washing shaft for transmission of the rotating power to the pulsator, a motor having a stator and a rotor for rotating the rotor by providing an electric power to the stator, and a clutch mechanism for switching a power transmission path from the motor to the washing shaft or the spinning shaft.

In a second aspect of the present invention, there is provided a method for controlling a full automatic washing machine including a BLDC motor, a driving source of the washing machine, having a rotor coupled to a washing shaft and a stator surrounding the rotor in an outer side thereof, a clutch motor for moving a coupling up or down to a washing or spinning position, and the coupling for moving up or down in association with a movement of the clutch motor to transmit a power to the washing shaft only in washing, and to the washing shaft and a spinning shaft fitted on an outer side thereof on the same time in spinning, the method including the step of alternating a direction of rotation of the BLDC motor for releasing seizure of the coupling before a step for moving the coupling up to a washing mode position is carried out by turning on the clutch motor after water supply is finished for washing, whereby preventing seizure of moving up of the coupling caused by the serrations in the inside circumferential surface of the coupling receiving opposite facial pressures from the serration in the lower part of the spinning shaft and the serration in the upper part of the inner connector, coming from setting of the spinning shaft and the inner connector engaged with the coupling in opposite directions in a seized state in a previous stop.

In a third aspect of the present invention, there is provided a method for controlling a full automatic washing machine including a BLDC motor, a driving source of the washing machine, having a rotor coupled to a washing shaft and a stator surrounding the rotor in an outer side thereof, a clutch motor for moving a coupling up or down to a washing or spinning. position, the coupling for moving up or down in association with a movement of the clutch motor to transmit a power to the washing shaft only in washing, and to the washing shaft and a spinning shaft fitted on an outer side thereof on the same time in spinning, and a coupling stopper for preventing rotation of the coupling when a washing mode is carried out as the coupling is moved up by the clutch motor, the method including the step of alternating a direction of rotation of the BLDC motor for releasing seizure of the coupling right before a step for moving the coupling down to a spinning mode position is carried out by turning on the clutch motor for switching to the spinning mode after washing is finished, whereby preventing seizure of moving down of the coupling caused by the gear teeth of the coupling and the gear teeth of the coupling stopper receiving opposite facial pressures from each other, coming from setting of the coupling to the coupling stopper in a seized state in a previous stop.

In a fourth aspect of the present invention, there is provided a method for controlling a full automatic washing machine including a BLDC motor, a driving source of the washing machine, having a rotor coupled to a washing shaft and a stator surrounding the rotor in an outer side thereof, a clutch motor for moving a coupling up or down to a washing or spinning position, and the coupling for moving up or down in association with a movement of the clutch motor to transmit a power to the washing shaft only in washing, and to the washing shaft and a spinning shaft fitted on an outer side thereof on the same time in spinning, the method including the steps of (a) supplying water for washing, (b) rotating the cam of the clutch motor positioned at an initial point in a switch off state by turning on the clutch motor after the water supply, (c) counting time on the same time with the turning on of the clutch motor, (d) determining attainment of a change to a switch on state of the switch in the clutch motor within a preset time period following rotation of the cutch motor, (e) counting a number of pulses produced from the clutch motor right after the switch on in a case the change to a switch on state of the switch in the clutch motor is attained as a result of the determination in the step (d), (f) determining the number of pulses counted in the step (e) of being reached to a preset number of pulses, (g) turning off the clutch motor to hold a position of the cam in a case the number of pulses is reached to the preset number of pulses as a result of determination in the step (f), (h) turning off the clutch motor in a case the change to a switch on state of the switch in the clutch motor is not attained even if the preset time period is passed as a result of the determination in the step (d), (i) alternating a direction of rotation of the BLDC motor for a time period in short intervals after the step (h) for making a seizure releasing action, (j) checking a number of times of the seizure releasing actions carried out by the BLDC motor, (k) carrying out the step (b) again to turn on the clutch motor to drive the cam in a case the number of times of the seizure releasing actions carried out by the BLDC motor is not reached to a preset number of times of the seizure releasing actions as a result of the checking in the step (j) and (l) displaying an error and stopping the washing machine in a case the number of times of the seizure releasing actions carried out by the BLDC motor is reached to a preset number of times of the seizure releasing actions as a result of the checking in the step (j).

In a fifth aspect of the present invention, there is provided a method for controlling a full automatic washing machine including a BLDC motor, a driving source of the washing machine, having a rotor coupled to a washing shaft and a stator surrounding the rotor in an outer side thereof, a clutch motor for moving a coupling up or down to a washing or spinning position, and the coupling for moving up or down in association with a movement of the clutch motor to transmit a power to the washing shaft only in washing, and to the washing shaft and a spinning shaft fitted on an outer side thereof on the same time in spinning, the method including the steps of (a) turning on the clutch motor to rotate the cam in a switch on state of the switch in the clutch motor when the cam is positioned at a holding point, (b) counting time on the same time with the turning on of the clutch motor, (c) determining attainment of a change to a switch off state of the switch in the clutch motor within a preset time period following rotation of the cutch motor, (d) counting a driving time period of the clutch motor newly right after the switch off in a case the change to the switch off state of the switch in the clutch motor is attained within a preset time period as a result of the determination in the step (c), (e) determining the driving time period counted in the step (d) of being reached to a preset time period, (f) turning off the clutch motor to hold a position of the cam at an initial point in a case the driving time period of the clutch motor starting from a time right after the switch off is reached to the preset time period as a result of determination in the step (e), (g) turning off the clutch motor in a case the change to the switch off state of the switch in the clutch motor is not attained even if the preset time period is passed as a result of the determination in the step (c), (h) alternating a direction of rotation of the BLDC motor for a time period in short intervals after the step (g) for making a seizure releasing action, (i) checking a number of times of the seizure releasing actions carried out by the BLDC motor, (j) carrying out the step (a) again to turn on the clutch motor to drive the cam in a case the number of times of the seizure releasing actions carried out by the BLDC motor is not reached to a preset number of times of the seizure releasing actions as a result of the checking in the step (i), and (k) displaying an error and stopping the washing machine in a case the number of times of the seizure releasing actions carried out by the BLDC motor is reached to the preset number of times of the seizure releasing actions as a result of the checking in the step (i).

In sixth aspect of the present invention, there is provided a method for controlling a full automatic washing machine including a BLDC motor, a driving source of the washing machine, having a rotor coupled to a washing shaft and a stator surrounding the rotor in an outer side thereof, a clutch motor for moving a coupling up or down to a washing or spinning position, and the coupling for moving up or down in association with a movement of the clutch motor to transmit a power to the washing shaft only in washing, and to the washing shaft and a spinning shaft fitted on an outer side thereof on the same time in spinning, the method including the steps of (a) turning on a power switch, (b) detecting switch on/off of a switch in the clutch motor at a time point the power switch is turned on, (c) turning on the clutch motor to rotate the cam in a case the switch in the clutch motor is in a switch on state as a result of detection in the step (b), (d) counting time on the same time with the turning on of the clutch motor, (e) determining attainment of a change to a switch off state of the switch in the clutch motor within a preset time period following rotation of the cutch motor, (f) counting a driving time period of the clutch motor newly right after the switch off in a case the change to the switch off state of the switch in the clutch motor is attained within a preset time period as a result of the determination in the step (e), (g) determining the driving time period counted in the step (f) of being reached to a preset time-period, (h) turning off the clutch motor to hold a position of the cam at an initial point in a case the driving time period of the clutch motor starting from a time right after the switch off is reached to the preset time period as a result of determination in the step (g), (i) turning off the clutch motor in a case the change to the switch off state of the switch in the clutch motor is not attained even if the preset time period is passed as a result of the determination in the step (e), ()) alternating a direction of rotation of the BLDC motor for a time period in short intervals after the step (i) for making a seizure releasing action, (k) checking a number of times of the seizure releasing actions carried out by the BLDC motor, (l) carrying out the step (c) to turn on the clutch motor to rotate the cam again in a case the number of times of the seizure releasing actions carried out by the BLDC motor is not reached to a preset number of times of the seizure releasing actions as a result of the checking in the step (k), (m) displaying an error and stopping the washing machine in a case the number of times of the seizure. releasing actions carried out by the BLDC motor is reached to the preset number of times of the seizure releasing actions as a result of the checking in the step (k), (n) turning on the clutch motor to rotate the cam in a case the switch in the clutch motor is in a switch off state as a result of detection in the step (b), (o) counting time on the same time with the turning on of the clutch motor, (p) determining attainment of a change to a switch on state of the switch in the clutch motor within a preset time period following rotation of the cutch motor, (q) carrying out the step (c) in a case the change to a switch on state of the switch in the clutch motor is attained within a preset time period as a result of the determination in the step (p), (r) turning off the clutch motor in a case the change to the switch off state of the switch in the clutch motor is not attained even if the preset time period is passed as a result of the determination in the step (p), (s) alternating a direction of rotation of the BLDC motor for a time period in short intervals after the step (r) for making a seizure releasing action, (t) checking a number of times of the seizure releasing actions carried out by the BLDC motor, (u) carrying out the step (n) to turn on the clutch motor to rotate the cam again in a case the number of times of the seizure releasing actions carried out by the BLDC motor is not reached to a preset number of times of the seizure releasing actions as a result of the checking in the step (t), (v) displaying an error and stopping the washing machine in a case the number of times of the seizure releasing actions carried out by the BLDC motor is reached to the preset number of times of the seizure releasing actions as a result of the checking in the step (t).

IV. BRIEF DESCRIPTION OF DRAWINGS

FIG. 1 illustrates a section of a full automatic washing machine having a clutch mechanism applied thereto in accordance with a first preferred embodiment of the present invention, schematically, FIGS. 2A-2C illustrate sections of key parts each showing an operation of a clutch mechanism in accordance with a first preferred embodiment of the present invention, wherein FIG. 2A illustrates a washing state, FIG. 2B illustrates a spinning state, aid FIG. 2C illustrates a momentary seizure state;

FIG. 3A illustrates a bottom view across a line I-I in FIG. 2A, and FIG. 3B illustrates a bottom view across a line II-II in FIG. 2B;

FIG. 4A illustrates a developed view of parts of a coupling gear and a coupling stopper in a washing state, FIG. 4B illustrates a spinning state, and FIG. 4C illustrates a momentary seizure state, FIGS. 5A-5B illustrate sections of key parts each showing an operation of a clutch mechanism in accordance with a second preferred embodiment of the present invention, wherein FIG. 5A illustrates a washing state, and FIG. 5B illustrates a spinning state, FIGS. 6A-6B illustrate enlarged views of FIGS. 5A-5B, respectively, wherein FIG. 6A illustrates a washing state, and FIG. 6B illustrates a spinning state;

Figure 17A:
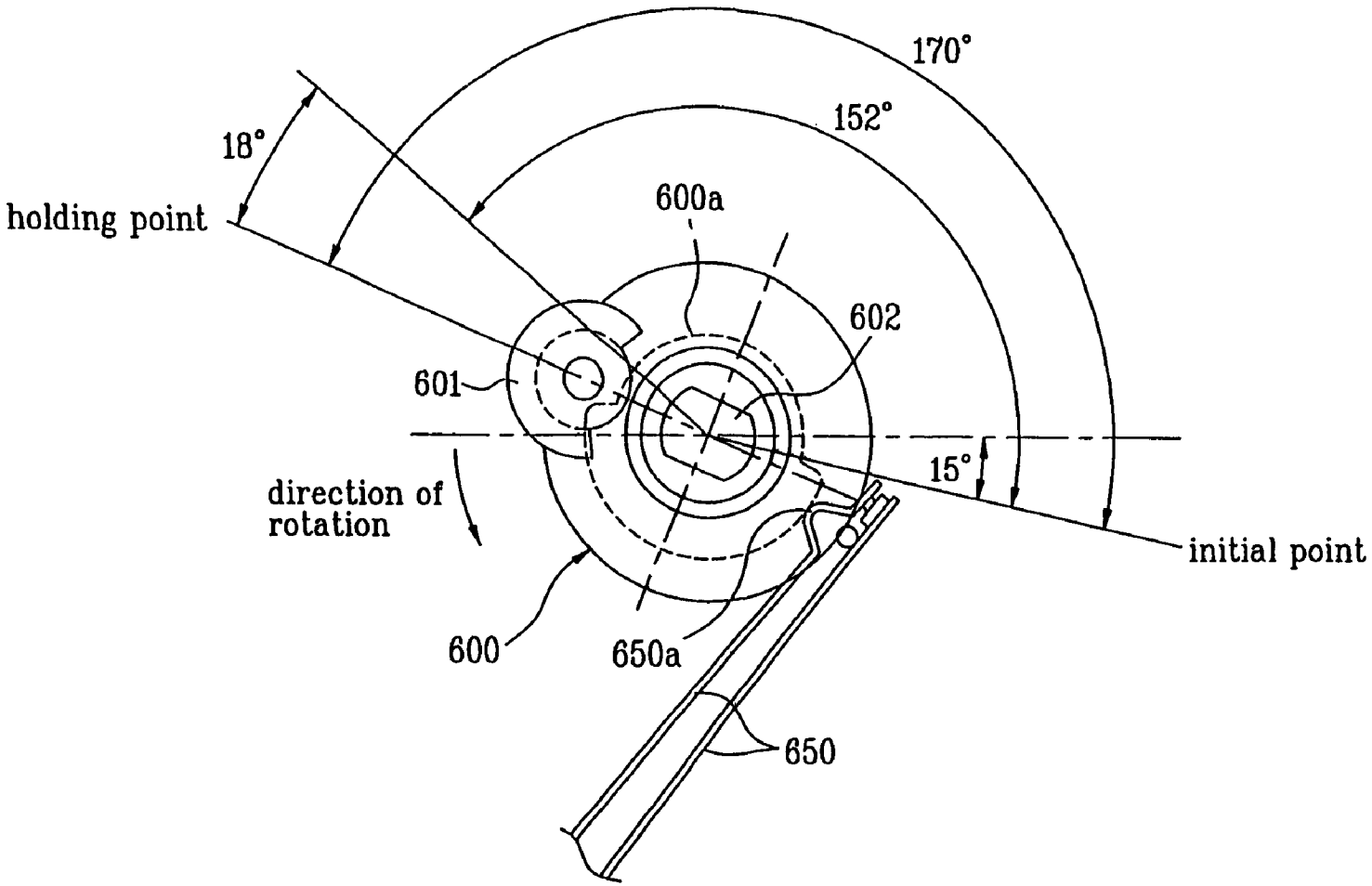
Figure 17B:
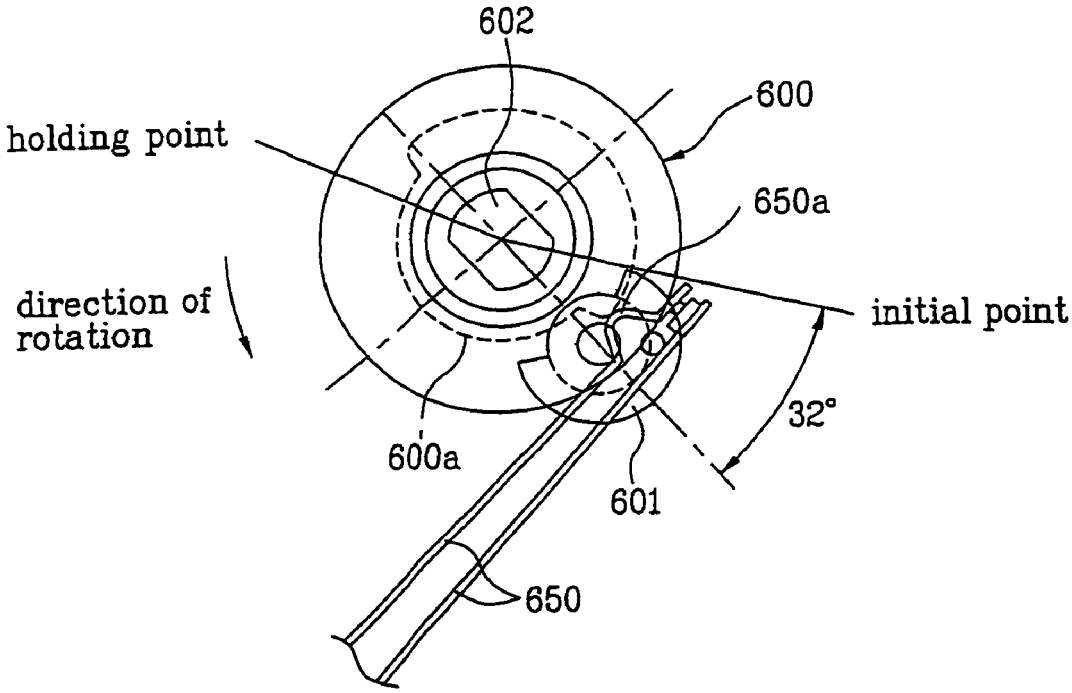
Figure 17C:
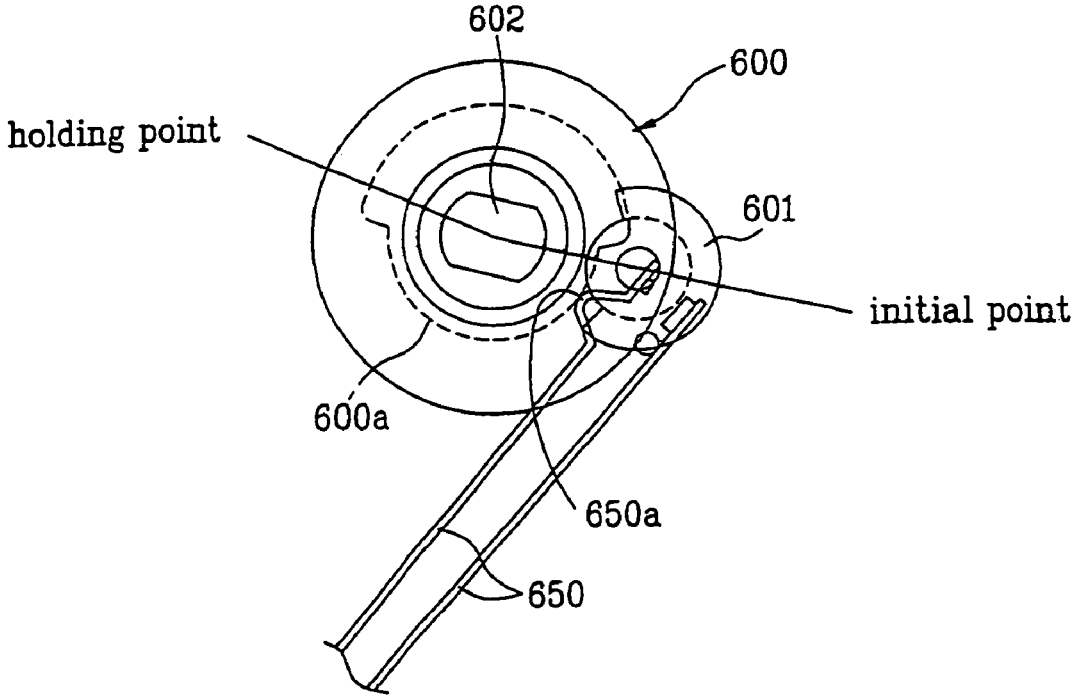
Figure 18:
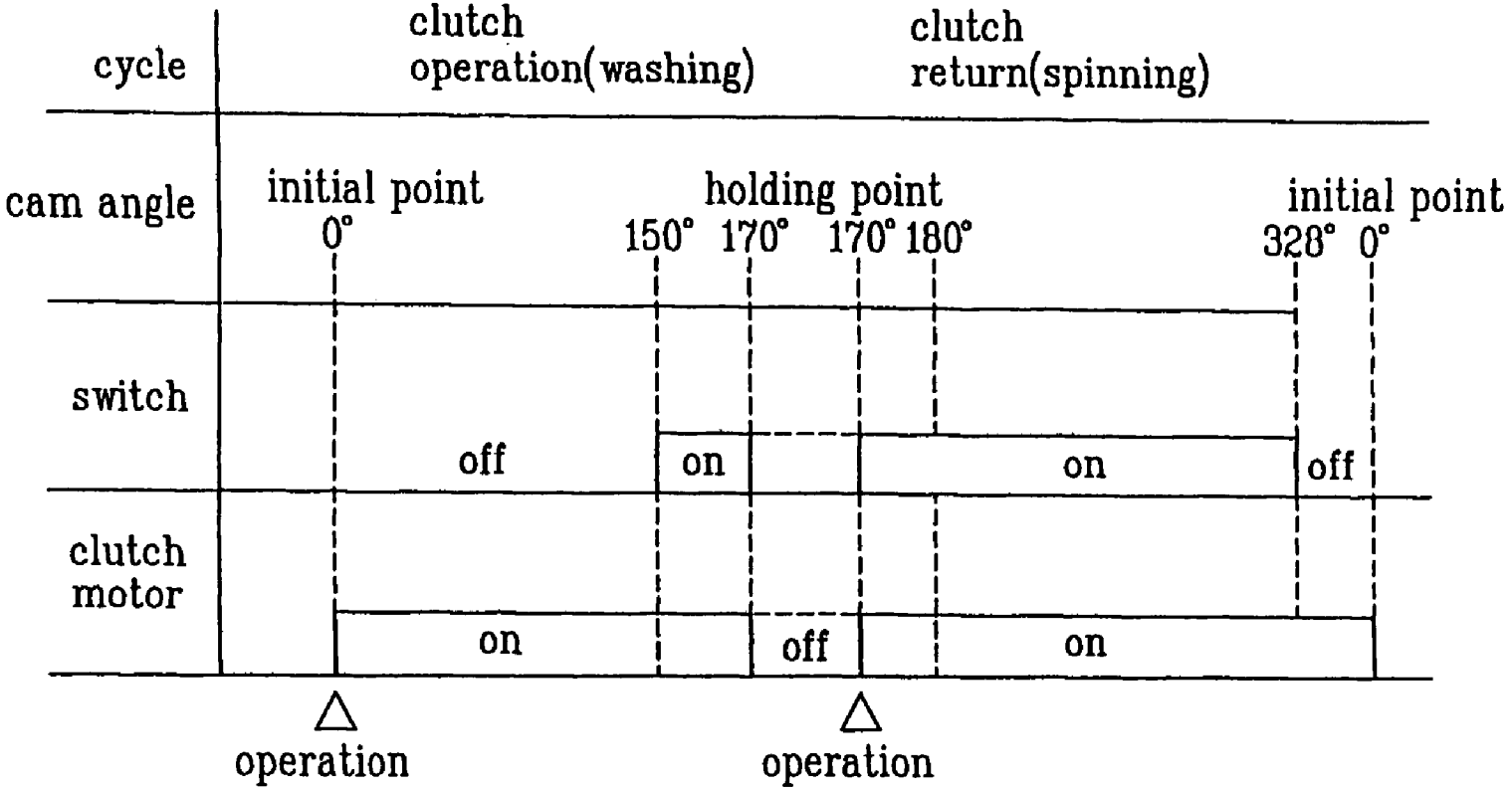
Figure 19:
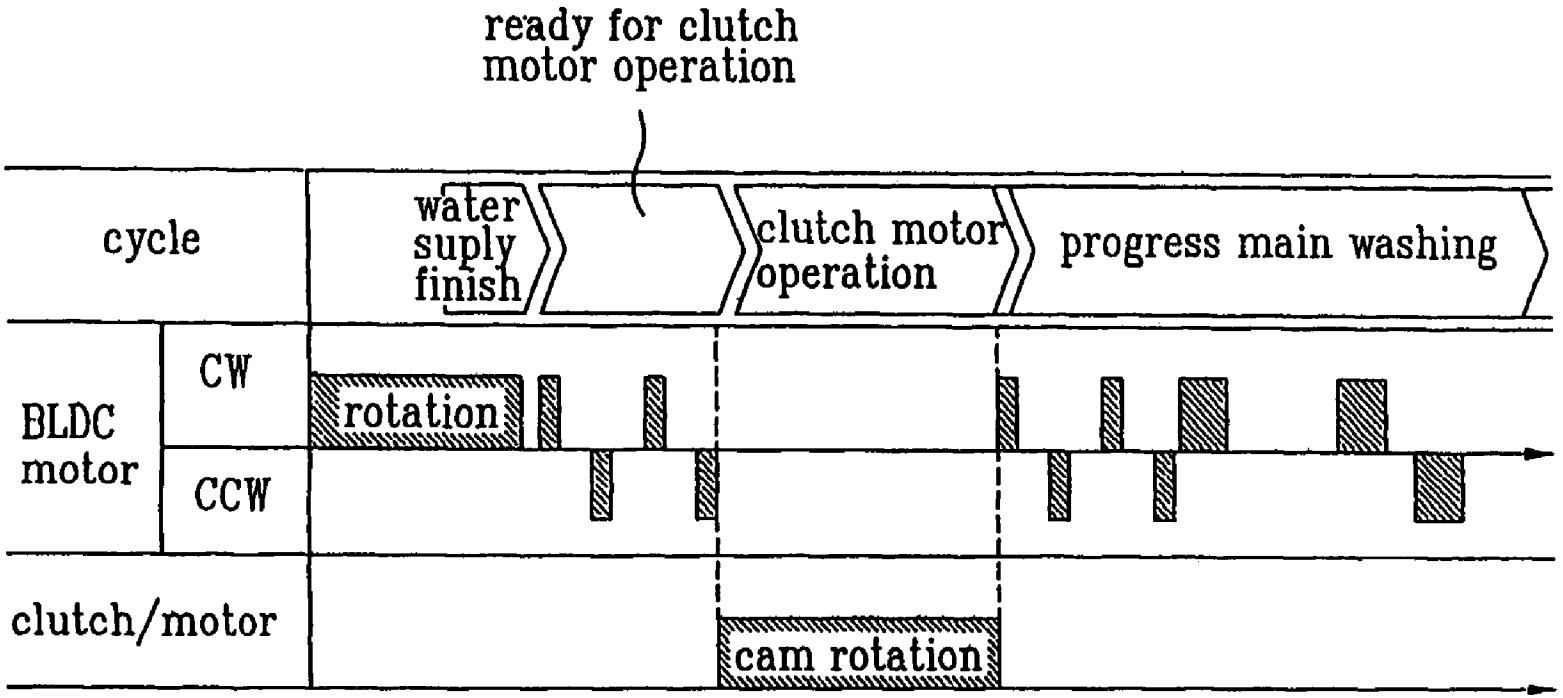
Figure 20:
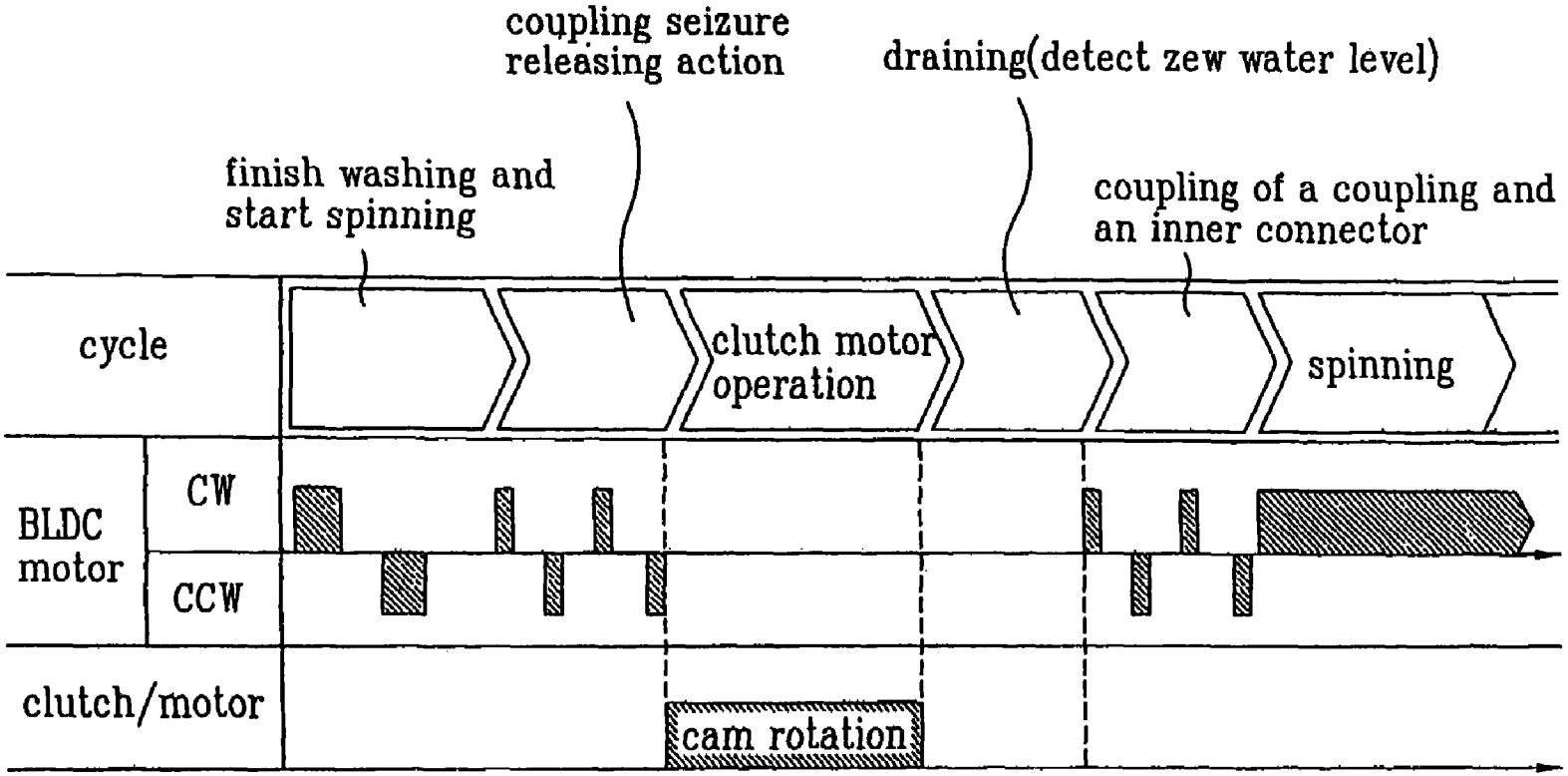
Figure 21:
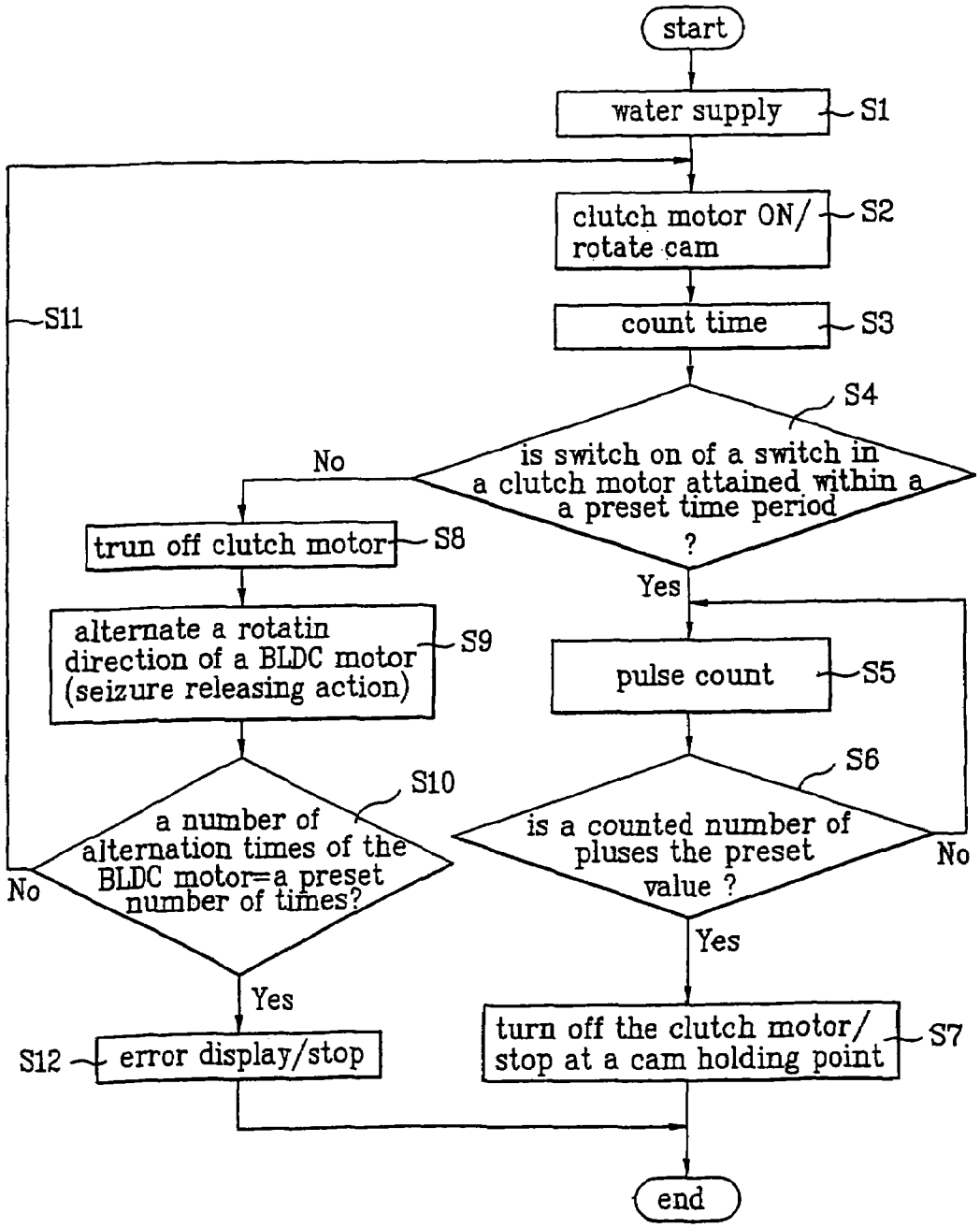
Figure 22:
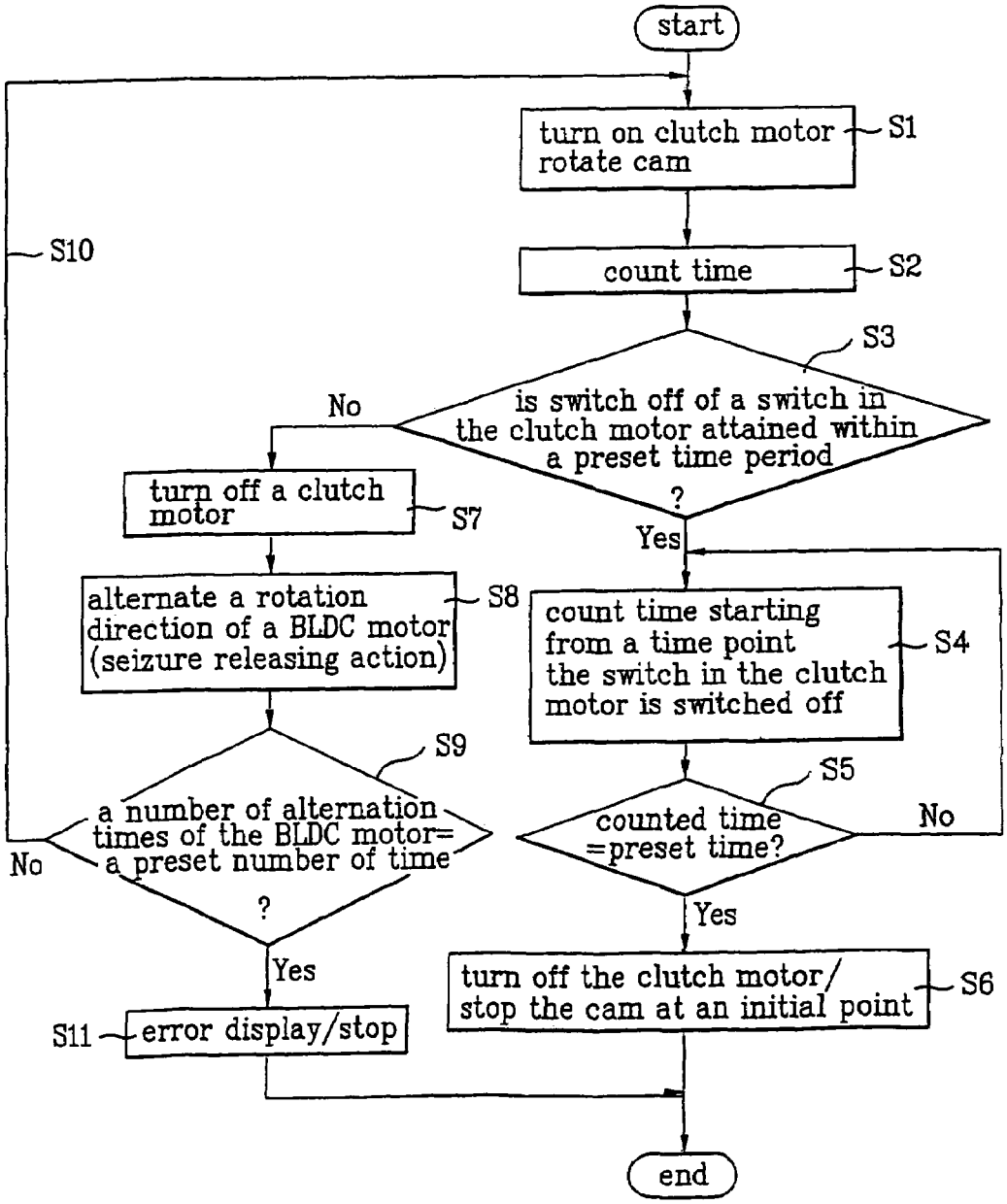
Figure 23:
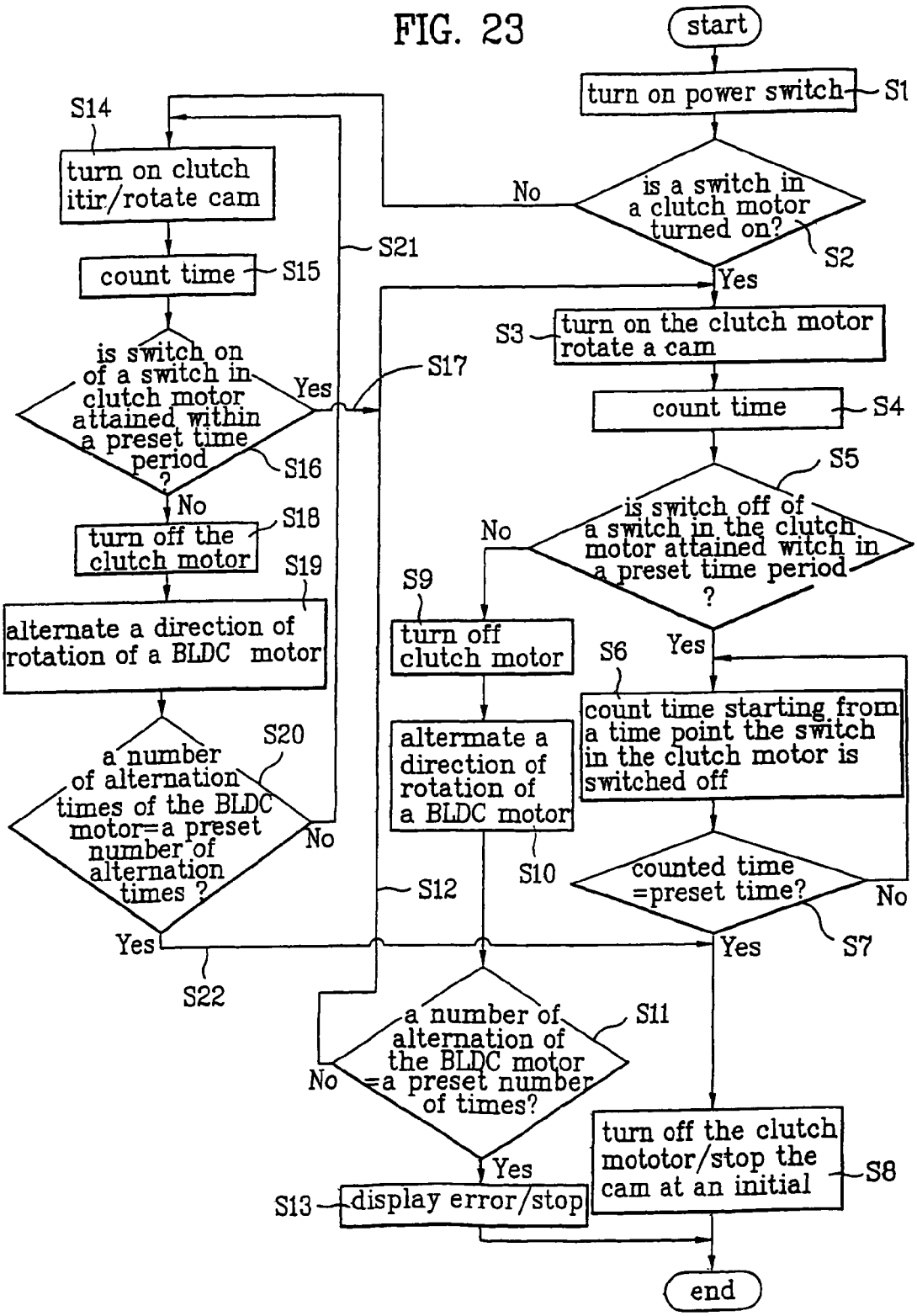

FIGS. 17A-17C illustrate operative relations of a driving cam and a switch in a clutch motor of the present invention schematically, wherein FIG. 17A illustrates a cam and switch state at a washing mode holding point, FIG. 17B illustrates a cam and switch state just before switching to a spinning mode, and FIG. 17C illustrates a cam and switch state at an initial point; and FIG. 18 illustrates a timing diagram showing operative relations between a clutch motor, cam, and switch in the present invention;

FIG. 19 illustrates a timing diagram showing operation of a BLDC motor and a clutch motor at an initial stage of washing in a washing machine in accordance with a preferred embodiment of the present invention;

FIG. 20 illustrates a timing diagram showing operation of a BLDC motor and a clutch motor at finish of washing and at an initial stage of spinning in a washing machine in accordance with a preferred embodiment of the present invention;

FIG. 21 illustrates a flow chart showing the steps of a process for controlling a clutch motor in change over of a washing mode in accordance with a preferred embodiment of the present invention;

FIG. 22 illustrates a flow chart showing the steps of a process for controlling a clutch motor in change over of a spinning mode in accordance with a preferred embodiment of the present invention; and FIG. 23 illustrates a flow chart showing the steps of a process for initializing a clutch motor in accordance with a preferred embodiment of the present invention.

V. BEST MODE FOR CARRYING OUT THE INVENTION

Figure 1:
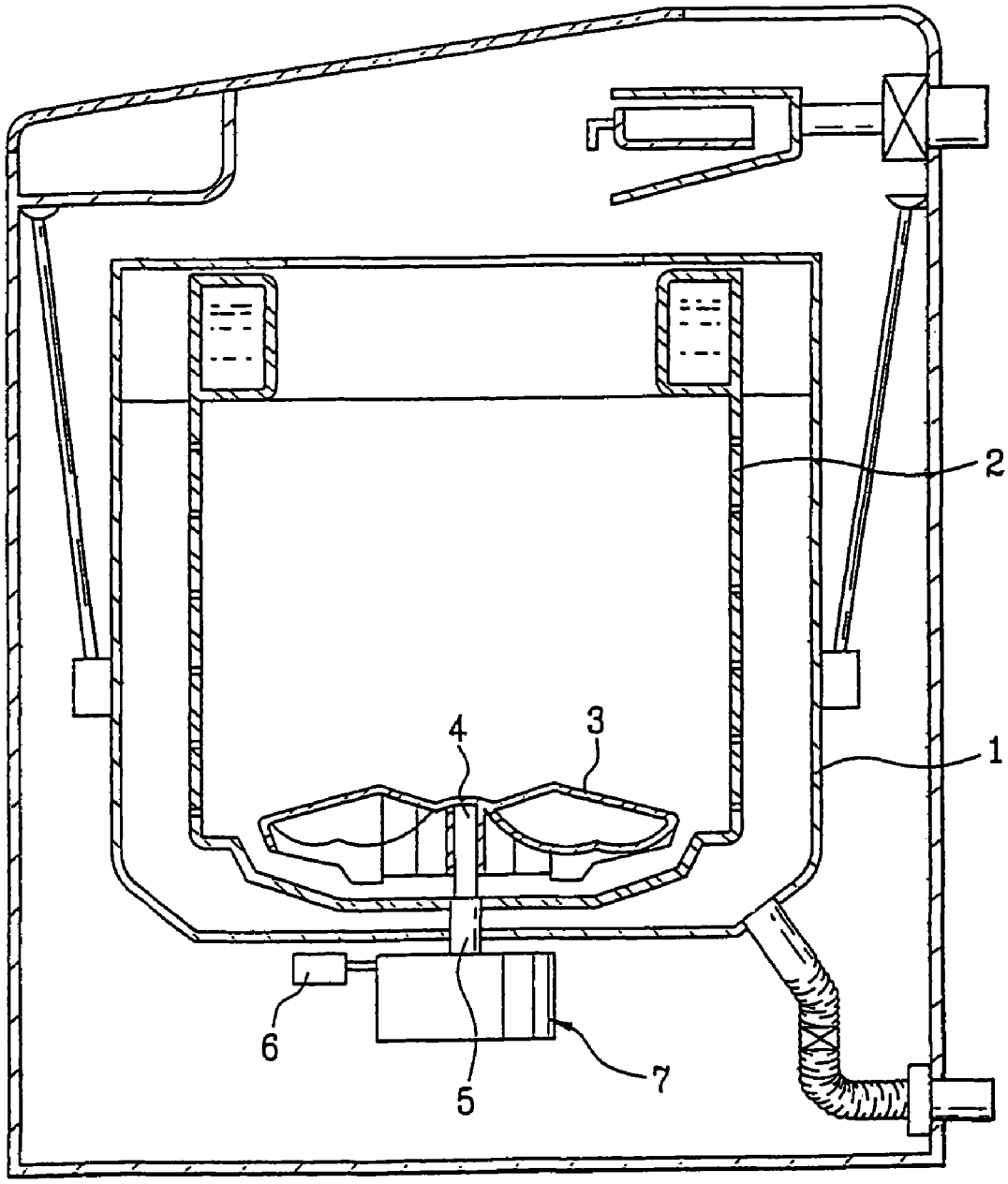
Figure 2A:
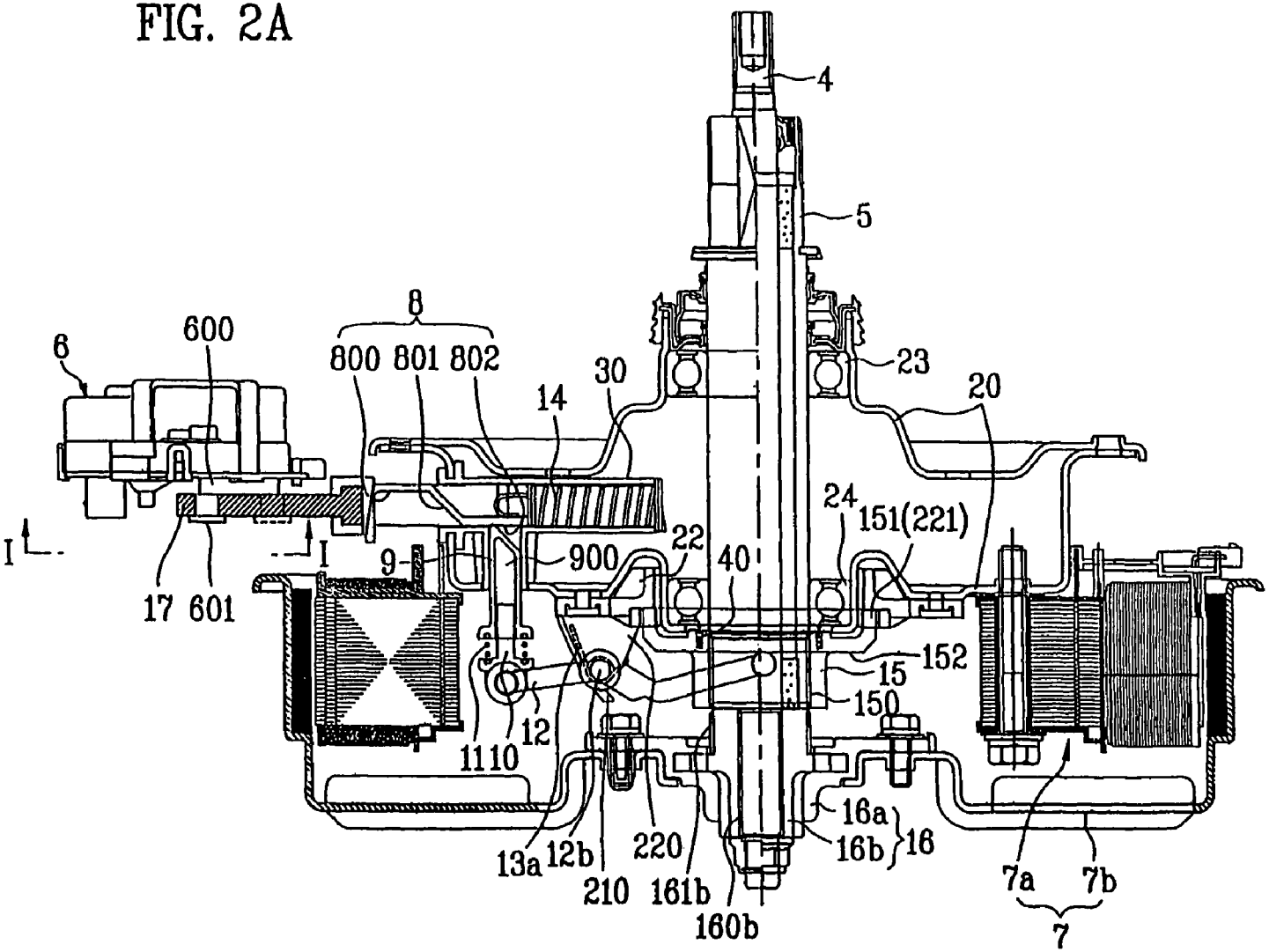
Figure 2B:
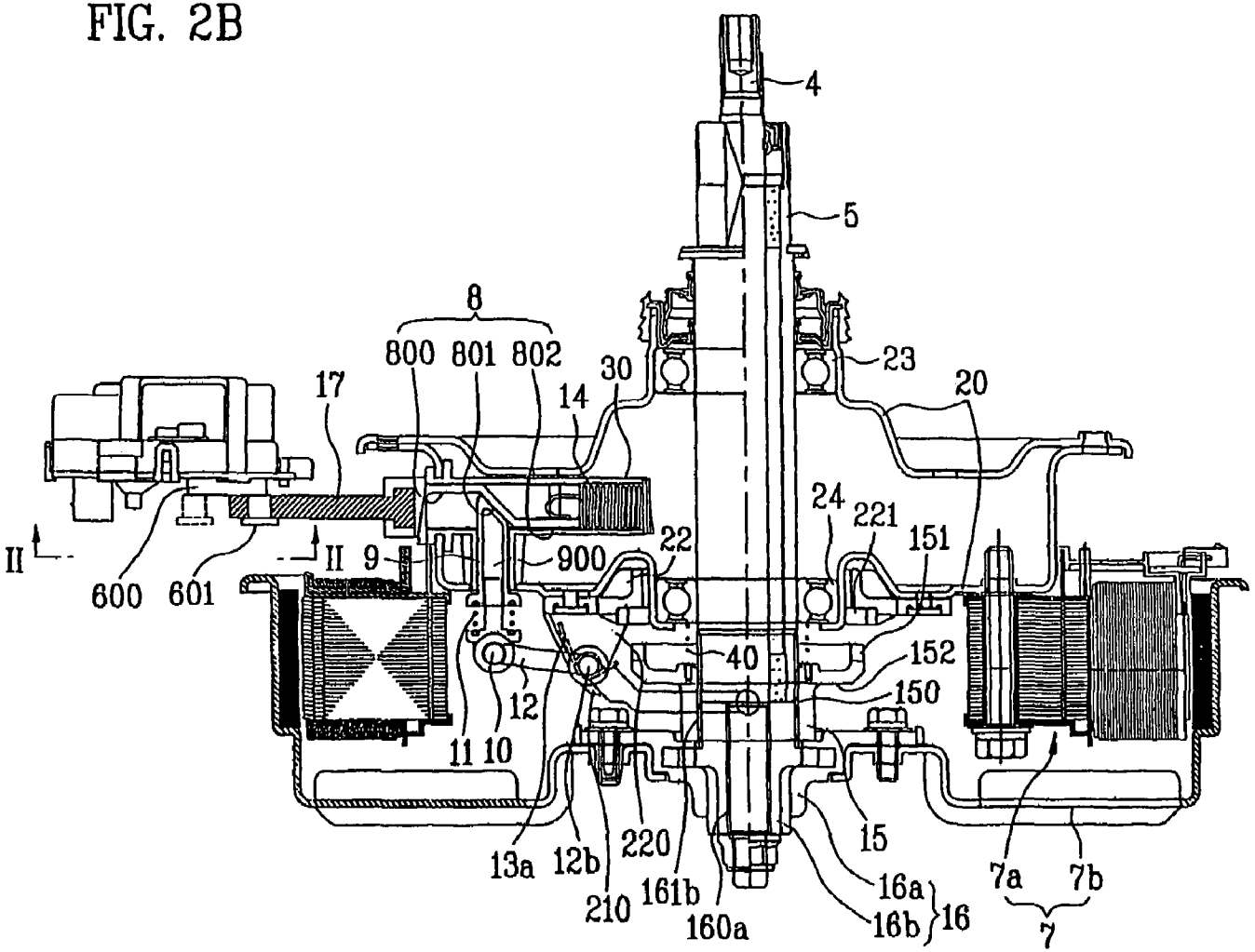
Figure 2C:
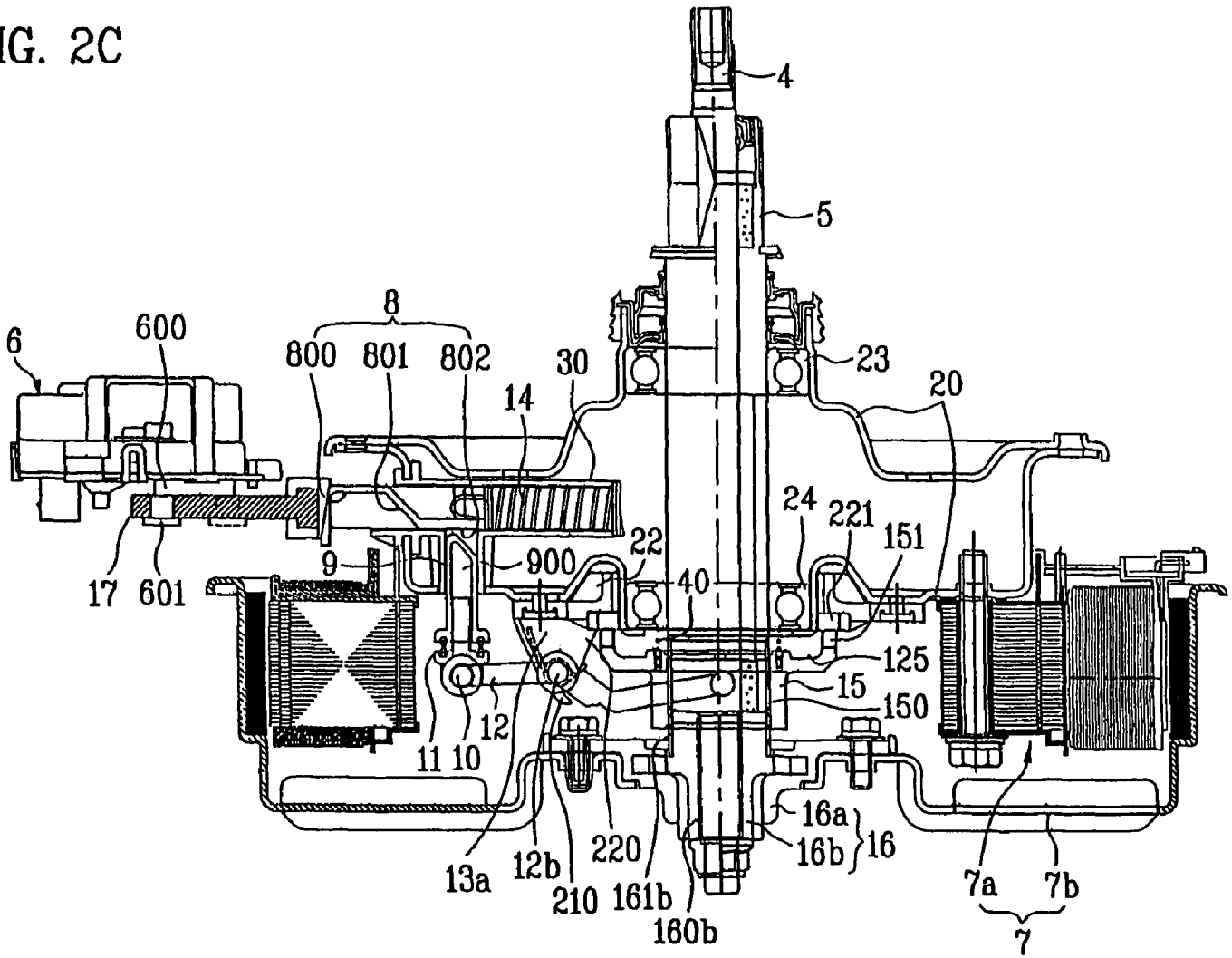
Figure 3A:
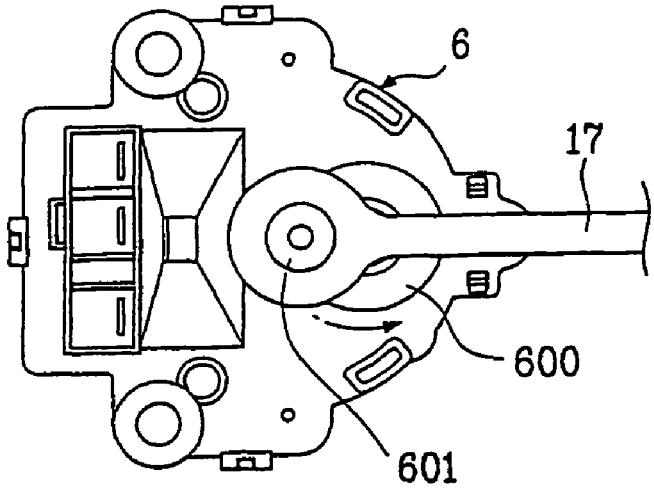
Figure 3B:
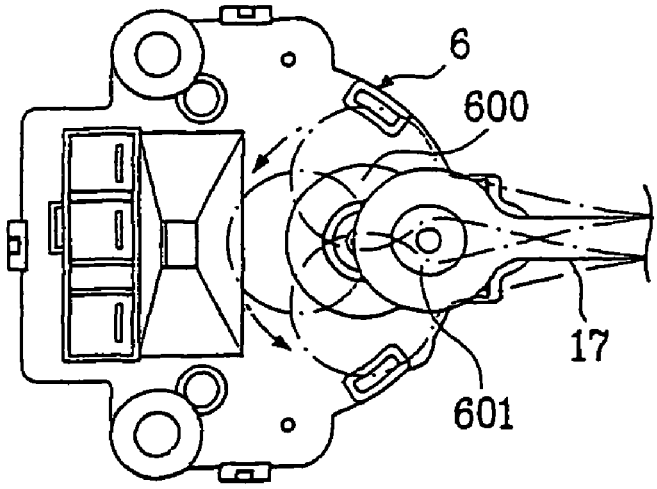

Preferred embodiments of the present invention will be explained, with reference to FIGS. 1-23. A first embodiment of the present invention will be explained, with reference to FIGS. 1-4C. FIG. 1 illustrates a section of a full automatic washing machine having a clutch mechanism applied thereto in accordance with a first preferred embodiment of the present invention schematically, FIGS. 2A-2C illustrate sections of key parts each showing an operation of a clutch mechanism in accordance with a first preferred embodiment of the present invention, FIG. 3A illustrates a bottom view across a line I-I in FIG. 2A, and FIG. 3B illustrates a bottom view across a line II-II in FIG. 2B.

Referring to the drawings, the full automatic washing machine in accordance with a first preferred embodiment of the present invention includes a spinning tub 2 rotatably fitted to an inside of an outer tub 1 of a main body, a pulsator 3 fitted to an inside of the spinning tub 2 rotatable independent from the spinning tub 2, a spinning shaft 5 rotatably held in a shaft holding bearing case 20 for transmission of a rotating power to the spinning tub 2, a washing shaft 4 for transmission of the rotating power to the pulsator 3, a motor 7 having a stator 7*a* and a rotor 7*b* in which the rotor 7*b* rotates as the stator 7*a* is provided with an electric power, and a clutch mechanism for switching a power transmission path of the motor 7 to the washing shaft 4 or the spinning shaft 5. The clutch mechanism may also be described as including a first link member and a second link member. The first link member may include, for example, hollow mover 9, plunger 10, and buffer spring 11. The second link member may include, for example, movable rod 12, fixed pin 12*b*, and coupling stopper 22.

The clutch mechanism includes a clutch motor 6 fitted under the outer tub 1, a cam 600 coupled with a driving shaft 602 of the clutch motor 6, a lever guide 30 fixed to the shaft holding bearing case 20, a lever 8 having a recess 800 with a sloped surface 801, and a flat surface 802 horizontally extended from a lower end of the sloped surface 801 for making a linear movement guided by the lever guide 30 when the clutch motor 6 is turned on/off, a connecting rod 17 between the cam 600 and lever 8 of the clutch motor 6 for pulling the lever 8 toward the clutch motor side when the clutch motor 6 is turned on, a return spring 14 having one end fixed to a fore end of the lever guide 30, and the other end fixed to a fixed projection from one side of the lever 8, for providing a return force to the lever 8, a hollow mover 9 for being brought into contact with the recess 800 with the sloped surface 801 of the lever 8 when the clutch motor 6 is turned off, and moving down along the sloped surface 801 until being positioned under the flat surface 802 when the clutch motor 6 is turned on, a plunger 10 movable in up and down directions along a guide groove 900 in the mover 9, a buffer spring 11 between the mover 9 and the plunger 10, a movable rod 12 having one end hinge coupled with a lower end of the plunger 10, a coupling stopper 22 fixed to an underside of the shaft holding bearing case 20 having gear teeth 221 formed along a circumference thereof, a fixed pin 12*b* fixed to a support bracket 220 of the coupling stopper 22 for serving as a rotation center of the movable rod 12 when the plunger 10 moves up and down, a coupling 15 for switching a rotation power transmission path of the motor 7 while moving up, or down along the spinning shaft S depending on a rotation direction of the movable rod 12, and a connector assembly 16 for transferring a rotation power from the rotor 7*b* to the washing shaft 6.

The clutch motor 6 is a geared motor for transferring a power to the driving shaft 602 coupled to the cam 600 at a reduced speed by means of gears. The connecting rod 17 has one end coupled to the cam 600 and the other end hinge coupled to the lever 8.

The coupling 15 includes an upper part having gear teeth 151 formed thereon for engagement with the gear teeth 221 on the coupling stopper 22, and an inside circumferential surface having a serration 150 formed therein for engagement with the serration in the spinning shaft 5 and a serration 161*b* in an outside circumferential surface in an upper part of an inner connector 16*b* of the connector assembly 16.

The connector assembly 16 includes an outer connector 16*a* of a resin fastened to the rotor with bolts, and an inner connector 16*b* injection molded of a metal as a unit with the outer connector 16*a* at an inside thereof having a serration 160*b* in an inside circumferential surface thereof for engagement with the serration in a lower part of the washing shaft 6, and a serration 161*b* in an outside circumferential surface of an upper part thereof exposed to an outside of the outer connector 16*a*. The inner connector 16*b* is formed of an aluminum alloy sintering, for improvement of strength.

There is a compression spring 40 between a top surface of the coupling 15 and a lower shaft supporting bearing 24 as an elastic member for pressing the coupling 15 down when the clutch motor 6 is turned off.

There is a stopper 210 on the support bracket 220 of the coupling stopper 22 the fixing pin 12*b* is coupled thereto for making interference with the movable-rod 12 to limit a rotation angle of the movable rod 12, for limiting a position of downward movement of the coupling 15.

There is a torsion spring 13*a* on the support bracket 220 of the coupling stopper 22 the fixing pin 12*b* is coupled thereto as an elastic member for providing a rotational force such that the movable rod 12 rotates in a clockwise direction around the fixing pin 12*b* when the clutch motor 6 is turned off.

Unexplained reference symbol 23 refers to an upper shaft support bearing.

The operation of the foregoing clutch mechanism in accordance with a preferred embodiment of the present invention will be explained.

The foregoing clutch mechanism in accordance with a preferred embodiment of the present invention maintain a state as shown in FIGS. 2B and 3B before washing is started as it is a turned off state when there is no power provided to the clutch motor 6.

That is, the mover 9 rests in the recess 800 with the sloped surface 801 of the lever 8, and the coupling 15 is at a lowest position.

Under this state, when power is provided to, and turns on, the clutch motor 6, a driving power is transmitted from the clutch motor 6 to the cam 600 through the driving shaft 602, the connecting rod 17 moves toward the clutch motor 6 by movement of the cam 600, and, according to this, the lever 8, guided by the lever guide 30, is pulled toward the clutch motor 6.

In this instance, the return spring 14 fitted to a rear end of the lever guide 30 is pulled.

In the meantime, as shown in FIG. 3A, if the lever 8 is pulled toward the clutch motor 6 fully, the mover 9 in contact with the sloped surface 801 of the lever 8 is pressed down to move downward until the mover 9 comes below the flat surface 802 of the lever 8 at a time the movement of the lever 8 is finished as shown in FIG. 2A.

When the mover 9 moves down following the movement of the lever 8, the mover 9 compresses the buffer spring 11, according to which the plunger 10, fitted to move up and down along the guide groove of the mover 9, also moves down.

Then, as the plunger 10 moves down, the movable rod 12 hinge coupled to the plunger 10 rotates in a counter clockwise direction when the drawing is seen from above around the fixing pin 12*b* passed through the support bracket 220 of the coupling stopper 22 fixed to the underside of the shaft bearing holding case 20.

Thus, when the movable rod 12 rotates in the counter clockwise direction when the drawing is seen from above around the fixing pin 12*b* thus, a fore end of the movable rod 12 pushes up the flange part 152 of the coupling 15 along the spinning shaft 5.

As a result, the gear teeth 151 on the upper part of the coupling 15 are engaged with the gear teeth 221 on the coupling stopper 22 fixed to the underside of the shaft holding bearing case 20. (see FIG. 4A).

Under a state the gear teeth 151 of the coupling 15 is engaged with the gear teeth 221 of the coupling stopper 22, the coupling is decoupled from the connector assembly 16, to rotate the washing shaft 6 only when the rotor 7*b* rotates.

That is, in washing, as the coupling 15 is in a state the serration 150 in the inside circumferential surface of the coupling 15 is only engaged with the serration in the outside circumferential surface of the spinning shaft 5, but not engaged with the serration. 161*b* in the upper part of the connector 16*b*, the rotation power of the rotor 7*b* is only transmitted to the pulsator 3 through the washing shaft 6.

The operation of the clutch mechanism in spinning will be explained.

While washing is progressed in a state as shown in FIGS. 2A-3A, if spinning is progressed after the washing is finished, power is provided to the clutch motor 6 again to rotate the cam 600. When the cam 600 rotates to a spinning position in the counter clockwise direction when the drawing is seen from above by the operation of the clutch motor 6, the lever 8 is moved away from the clutch motor 6 by a restoring force of the return spring 14.

According to this, referring to FIG. 3B, at a time point restoration of the lever 8 is finished, the mover 9 in contact with the flat surface 802 of the lever 8 in washing rests in the recess 800 having the sloped surface 801 of the lever 8.

When the mover 9 moves up following the movement of the lever 8, a compression force to the buffer spring 11 is eased, according to which the plunger 10, movable in up and down direction along the guide groove 900 in the mover 9, moves up, too.

Then, as the plunger 10 moves up, the movable rod 12 hinge coupled to the plunger. 10 rotates in a clockwise direction when the drawing is seen from above around the fixing pin 12*b* fitted to pass through the support bracket 220 of the coupling stopper 22 fixed to the underside of the shaft holding bearing case 20.

Thus, as the movable rod 12 rotates in the clockwise direction when the drawing is seen from above around the fixing pin 12*b*, the force of the fore end of the movable rod 12, pushing up the coupling 15 in a shaft upper part direction along the spinning shaft 5, is removed.

As the supporting force of the movable rod 12 to the coupling 15 is removed, the coupling moves down by gravity and the pushing force of the compression spring 40, to disengage the gear teeth 151 of the coupling 15 from the gear teeth 221 of the coupling stopper 22. (see FIGS. 2B and 4B).

When the coupling 15 moves down fully, the serration 150 in the inside circumferential surface of the coupling 15 is engaged both with the serration 161*b* in the outside circumferential surface of the upper part of the inner connector 16*b* coupled to the washing shaft 6, and the serration in the lower-part of the spinning shaft 5, such that both the washing shaft 6 and the spinning shaft 5 rotate at a high speed when the rotor 7*b* rotates at a high speed, to progress the spinning.

Figure 4A:
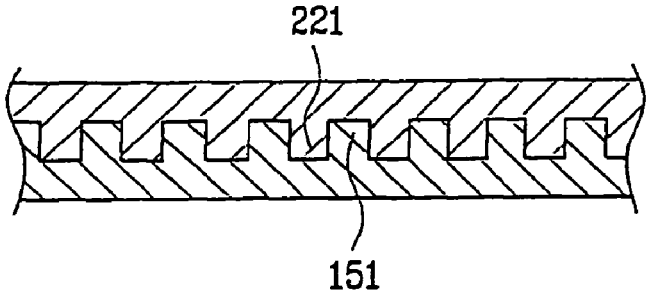
Figure 4B:
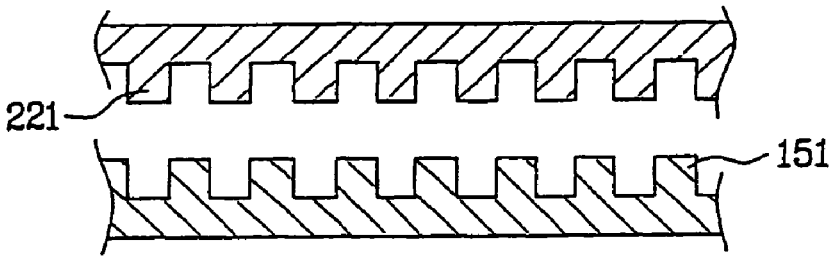
Figure 4C:
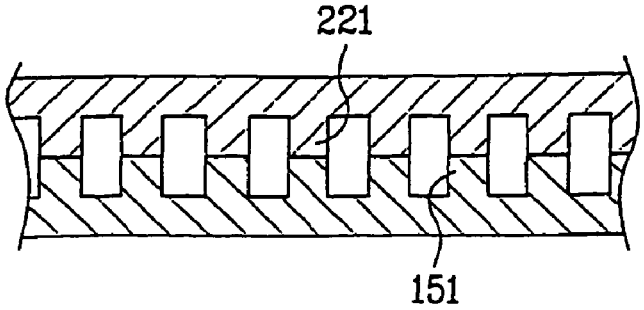

Meanwhile, when the engagement of the gear teeth 221 of the coupling stopper 22 with the gear teeth 151 of the coupling 15 is failed, there may be a state of momentary seizure of the coupling 15 as shown in FIGS. 2C, or 4C occurred in a power switching to a washing mode to proceed to a washing by driving the clutch motor 6.

That is, though positions of the gear teeth 221 are fixed as the coupling stopper 22 is fixed to the shaft holding bearing case 20, positions of the gear teeth 151 vary when the gear teeth are standstill as the coupling 15 is rotatable with the spinning shaft 5.

According to this, in switching to washing, there may be a case when crests of the gear teeth of the coupling 15 and crests of the gear teeth 221 of the coupling stopper 22 abut, which is called as a momentary seizure of the coupling 15.

In this instance, the coupling 15, slightly engaged with the serration 161*b* in the outside circumferential surface of the upper part of the inner connector 16*b*, rotates until the crests and spaces of the teeth meet, when the gear teeth 151 of the coupling 15 and the gear teeth 221 of the coupling stopper 22 engage smoothly as the buffer spring 11 between the mover 9 and the plunger 10 in the clutch mechanism of the present invention pushes, to free the momentary seizure of the coupling 15.

Instead of the formation of the serration in the lower part of the washing shaft 4, the lower part of the washing shaft is formed to be square, and the inside of the inner connector 16*b* is formed to be a square hollow fit to the square shaft, so that the square shaft and the square hollow are shaft coupled.

Though the foregoing embodiment shows a case when the connecting rod 17 and the lever 8 are hinge coupled, if the coupling of the connecting rod 17 with the lever 8 is not the hinge coupling, it is required that the connecting rod is formed of a flexible material.

Figure 5A:
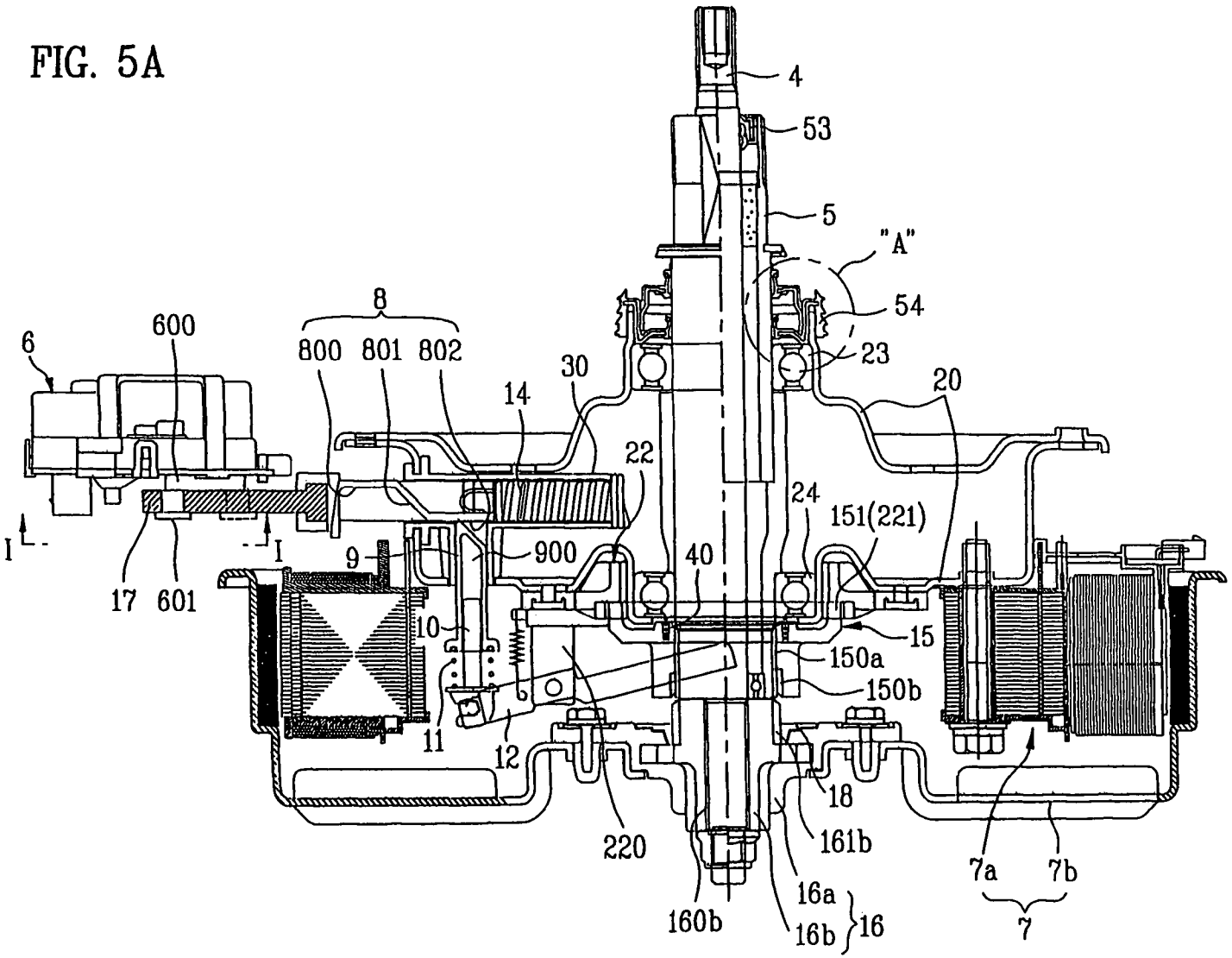
Figure 5B:
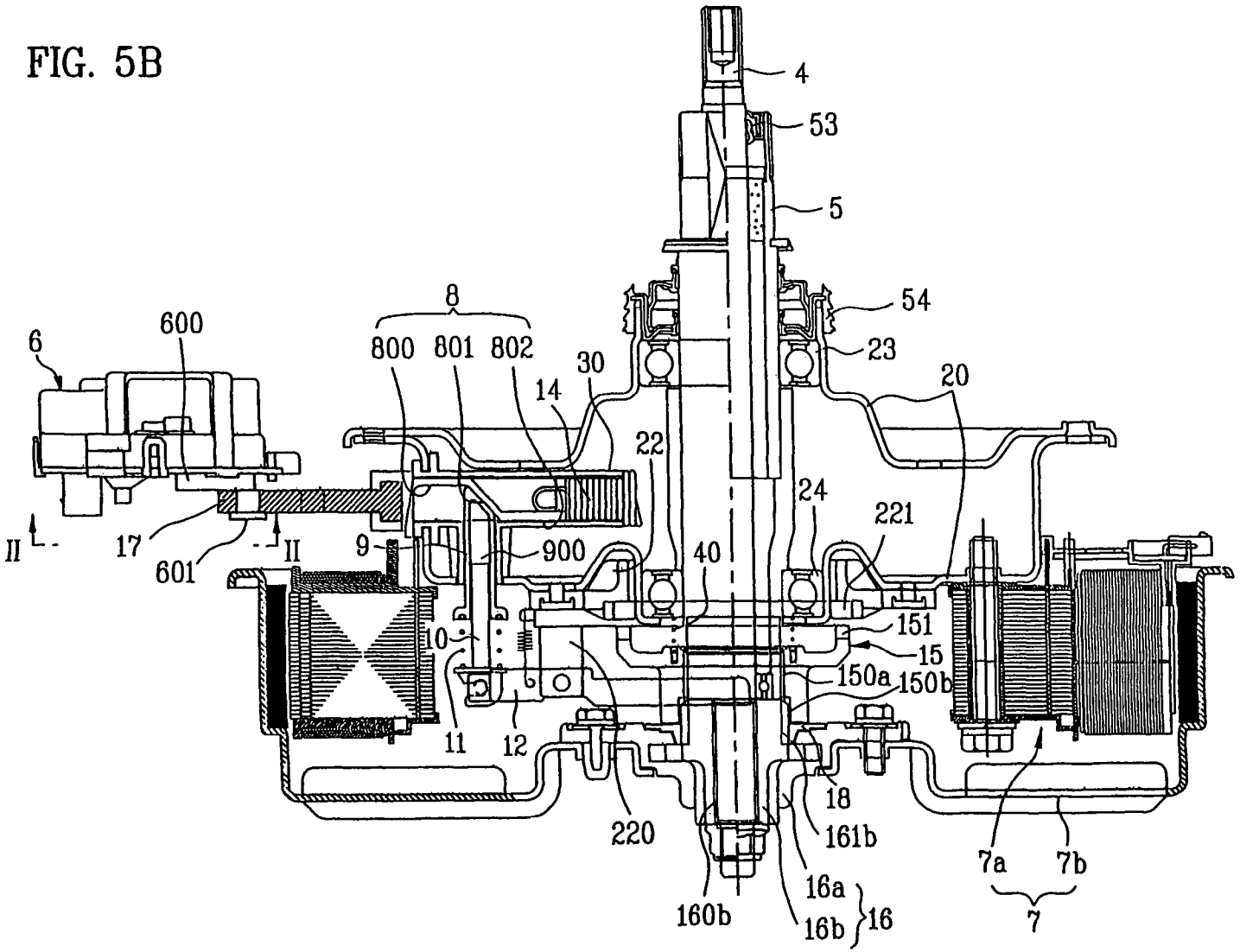
Figure 6A:
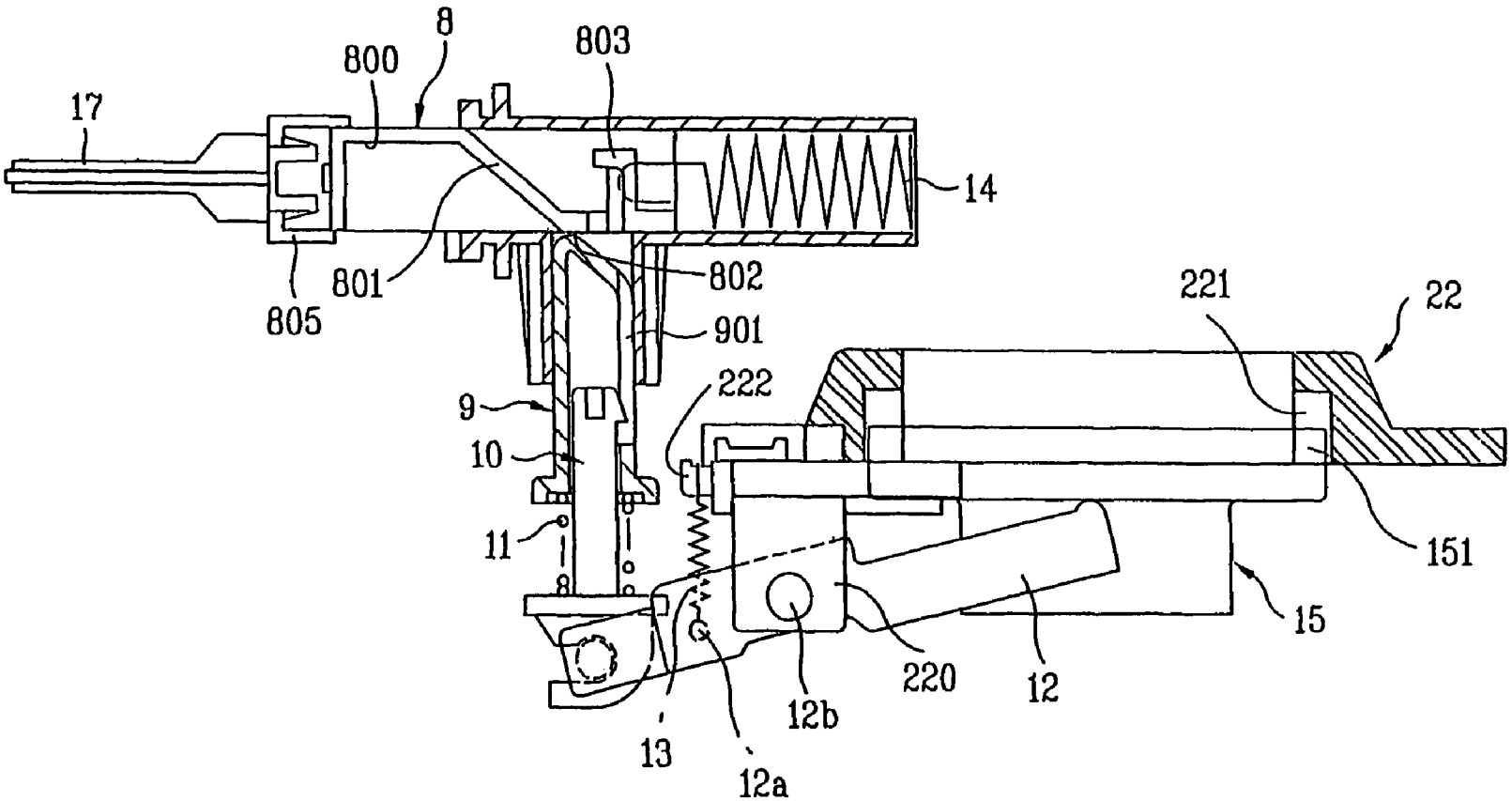
Figure 6B:
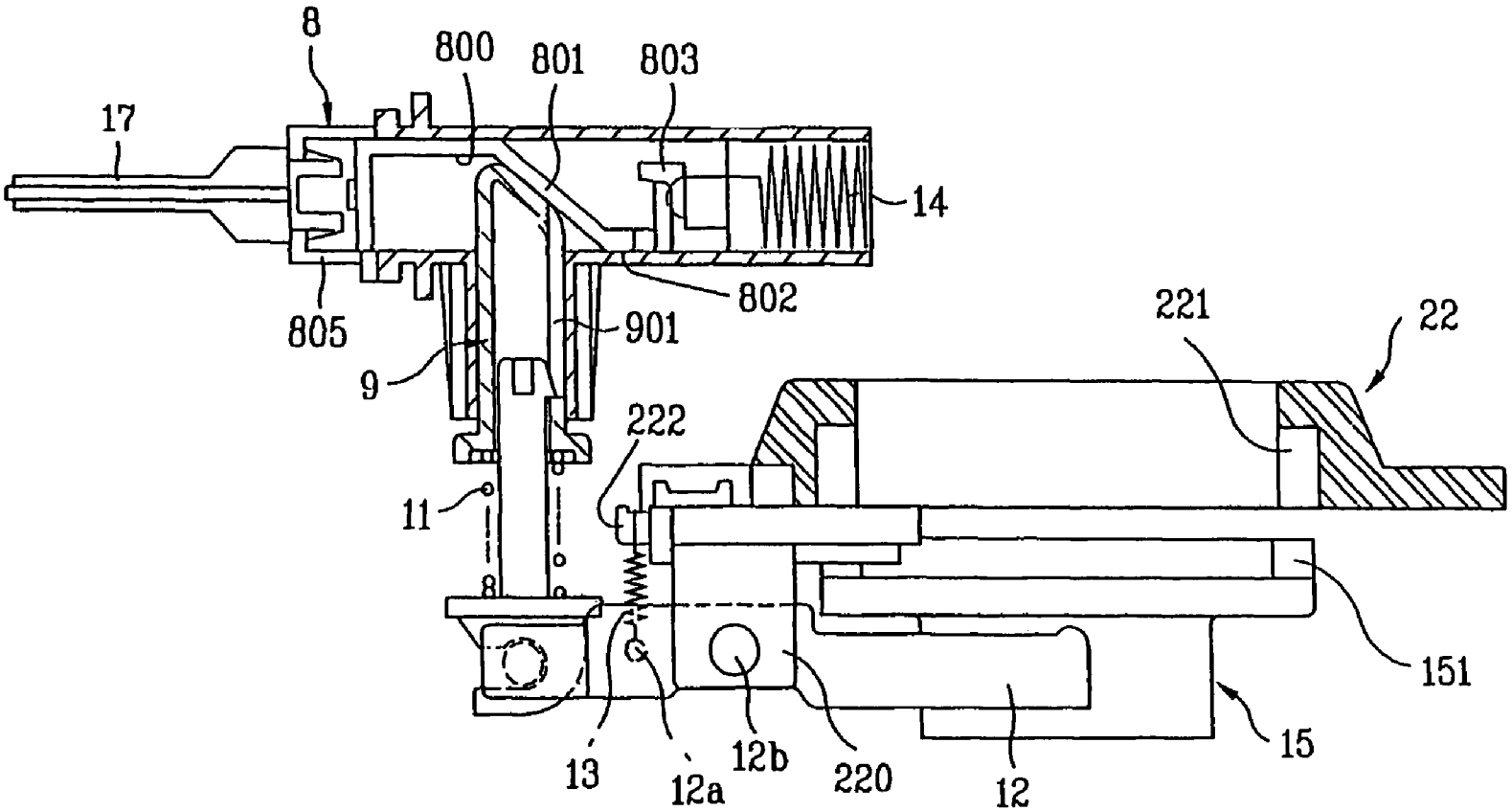
Figure 7A:
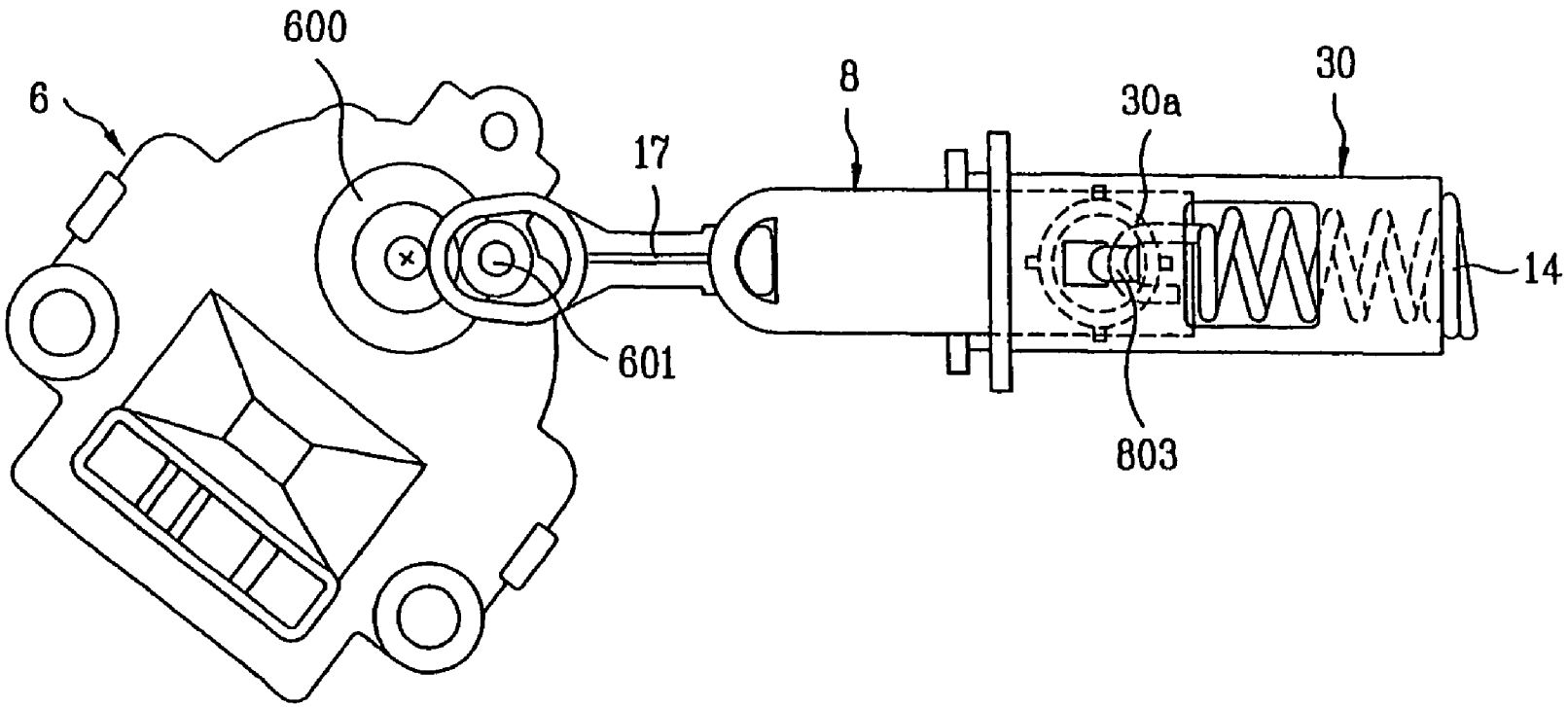
FIG. 7A illustrates a bottom view across a line I-I in FIG. 5A.
Figure 7B:
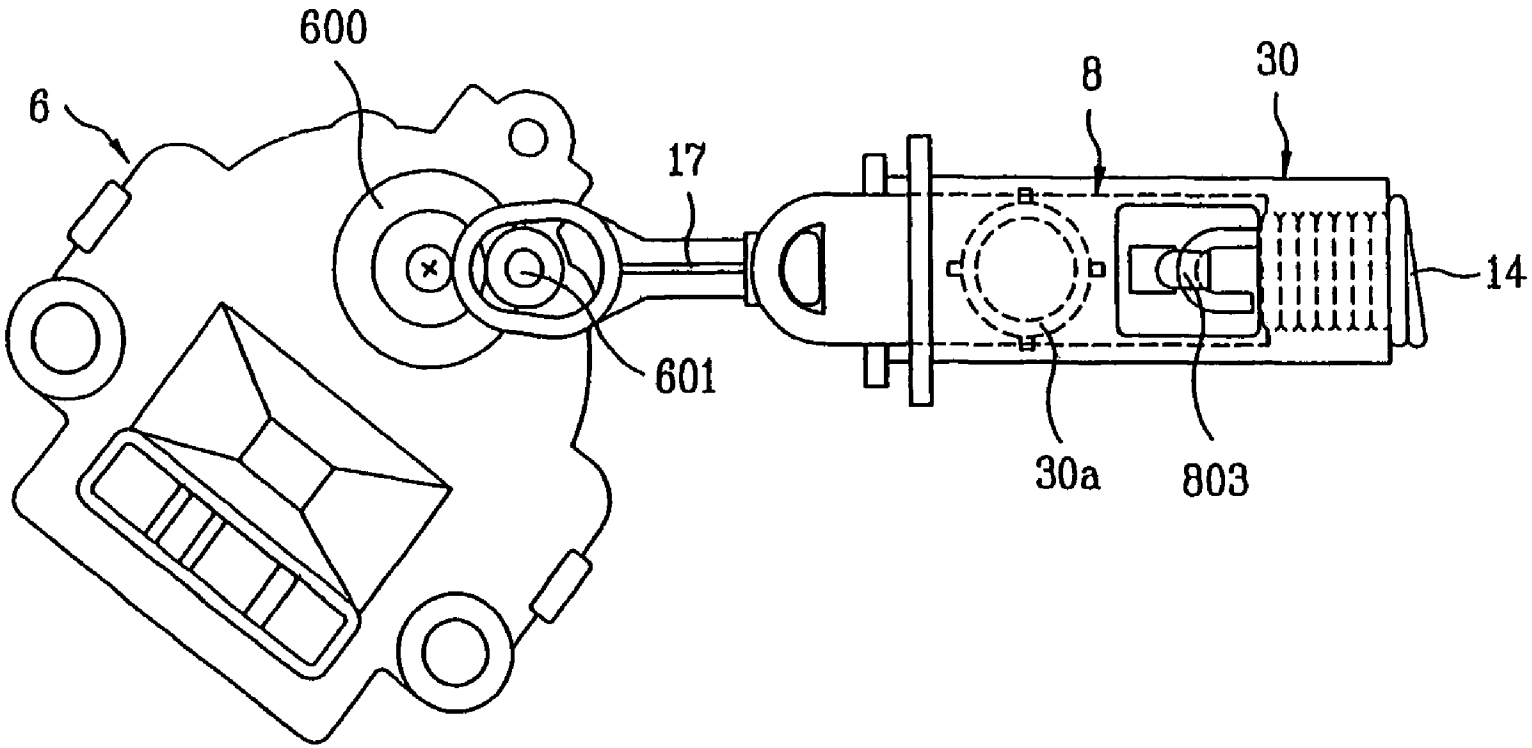
FIG. 7B illustrates a bottom view across a line II-II in FIG. 5B.

A second preferred embodiment of the present invention will be explained, with reference to FIGS. 5-23. FIGS. 5A-5B illustrate sections of key parts each showing an operation of a clutch mechanism in accordance with a second preferred embodiment of the present invention, FIGS. 6A-6B illustrate enlarged views of FIGS. 5A-5B respectively, FIG. 7A illustrates a bottom view across a line I-I in FIG. 5A, and FIG. 7B illustrates a bottom view across a line II-II in FIG. 5B.

The full automatic washing machine in accordance with a second preferred embodiment of the present invention also includes a washing and spinning tub 2 rotatably fitted to an inside of an outer tub 1, a pulsator 3 fitted to an inside of the spinning tub 2 so as to be rotatable independent from the spinning tub 2, a spinning shaft 5 rotatably held by a shaft holding bearing case 20 (see FIG. 5A) for transmission of a rotating power to the spinning tub 2, a washing shaft 4 for transmission of the rotating power to the pulsator 3, a BLDC motor 7 having a stator 7*a* and a rotor 7*b* for rotating the rotor 7*b* as electric power is provided to the stator 7*a*, and a clutch mechanism for switching a power transmission path from the BLDC motor 7 either to the washing shaft 4 or to the spinning shaft 5 in correspondence to a washing cycle, or a spinning cycle.

The clutch mechanism includes a clutch motor 6 fitted under the outer tub 1, a cam 600 coupled with a driving shaft 602 of the clutch motor 6, a lever guide 30 fixed to the shaft holding bearing case 20, a lever 8 having a recess 800 with a sloped surface 801, and a flat surface 802 horizontally extended from a lower end of the sloped surface 801 for making a linear movement guided by the lever guide 30 when the clutch motor 6 is in operation, a connecting rod 17 between the cam 600 and lever 8 of the clutch motor 6 for pulling the lever 8 toward the clutch motor side when the clutch motor 6 is turned on, a return spring 14 having one end fixed to a fore end of the lever guide 30, and the other end fixed to a catch projection at one side of the lever 8, for providing a return force to the lever 8, a hollow cylindrical mover 9 for being in contact with the recess 800 with the sloped surface 801 of the lever 8 in spinning, and moving down along the sloped surface 801 until being positioned under the flat surface 802 in switching to a washing mode, a plunger 10 movable in up and down directions along a guide groove 900 in the mover 9, a buffer spring 11 between the mover 9 and the plunger 10, a coupling stopper 22 fixed to an underside of the shaft holding bearing case 20 having gear teeth 221 formed along a circumferential direction thereof, a movable rod 12 having one side fore end hinge coupled with a lower end of the plunger 10, and one point of an intermediate part thereof hinge coupled with a lower end of a support bracket 220 below the coupling stopper 22, a coupling 15 for switching a rotation power transmission path of a BLDC motor 7 while moving up, or down along the spinning shaft 5 depending on a rotation direction of the movable rod 12, and a connector assembly 16 for transferring a rotation power from the rotor 7*b* to the washing shaft 4.

The clutch motor 6 is a geared motor having a reduction gear therein for transferring a power to the driving shaft 602 coupled to the cam 600 at a reduced speed.

The connector assembly 16 includes an outer connector 16*a* of a resin fastened to the rotor with bolts, and an inner connector 16*b* injection molded of a metal as a unit with the outer connector 16*a* at an inside thereof having a serration 160*b* in an inside circumferential surface thereof for engagement with the serration in a lower part of the washing shaft 6, and a serration 161*b* in an outside circumferential surface of an upper part thereof exposed to an outside of the outer connector 16*a*. The inner connector 16*b* is formed of an aluminum alloy sintering, for improvement of strength.

The outer connector 16*a* has an annular elastic member seat 162*a* in a center part of a top surface, and a rubber ring 18, the elastic member, is seated on the seat 162*a*

Figure 8:
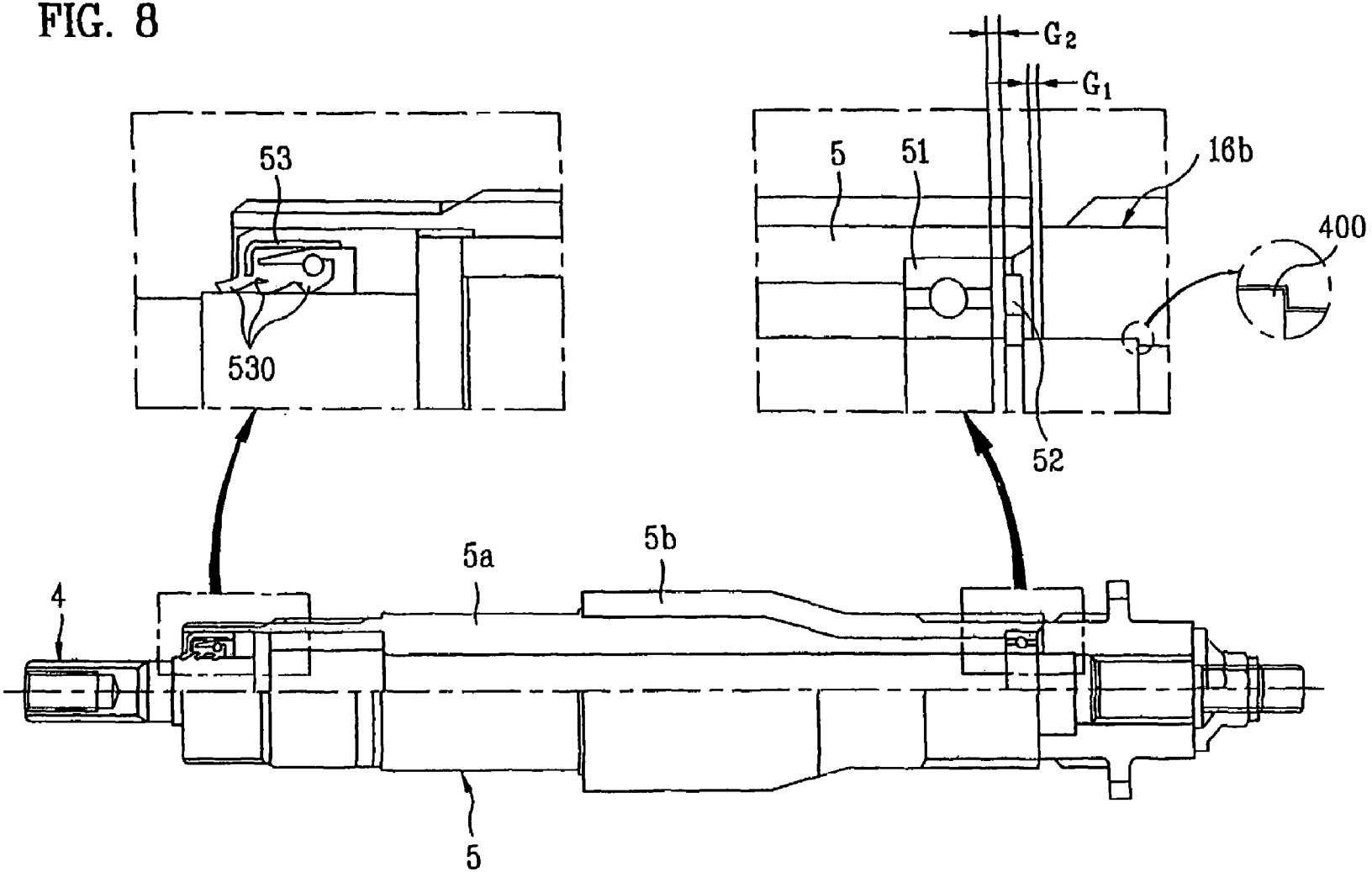
FIG. 8 illustrates an enlarged view showing structures of a washing shaft and a spinning shaft in FIG. 5A.

FIG. 8 illustrates an enlarged view showing structures of a washing shaft and a spinning shaft in FIG. 5A.

Referring to FIG. 8, different from the related art spinning shaft, the spinning shaft 5 includes a lower shaft part 5*b* with a large inside diameter, and an upper shaft part 5*a* press fit inside of an upper part of the lower shaft part 5*b*. An upper part of the lower shaft part 5*b* is held by the upper shaft holding bearing 23 which holds the spinning shaft 5.

The washing shaft 4 has a step 400 in a lower part thereof, and the inner connector 16*b* has a step fit to the step 400 on the washing shaft 4 in an inside circumferential surface thereof for defining a fastening position when the connector 16*b* is coupled to the lower part of the washing shaft 4 and fastened with a nut.

There is a gap provided between a lower end of the lower shaft part 5*b* of the spinning shaft 5 and a top end of the inner connector 16*b* for leading the inner connector 16*b* and the lower end of the lower shaft part 5*b* of the spinning shaft S to be brought into contact at first for prevention of bending of the shaft when the washing machine is dropped during shipment, or given an impact in other occasions.

The gap G1 between the inner connector 16*b* and the spinning shaft 5 is formed smaller than a gap G2 between a ball bearing 51 supporting a lower part of the washing shaft 4 in a radial direction and a C-ring 52.

There is a sealing member 53 in the upper part of the washing shaft 4 for prevention of infiltration of water between the washing shaft 4 and the spinning shaft 5. The sealing member 53 has at least three lips 530 provided at an inside thereof for securing a sealing reliability.

Figure 9:
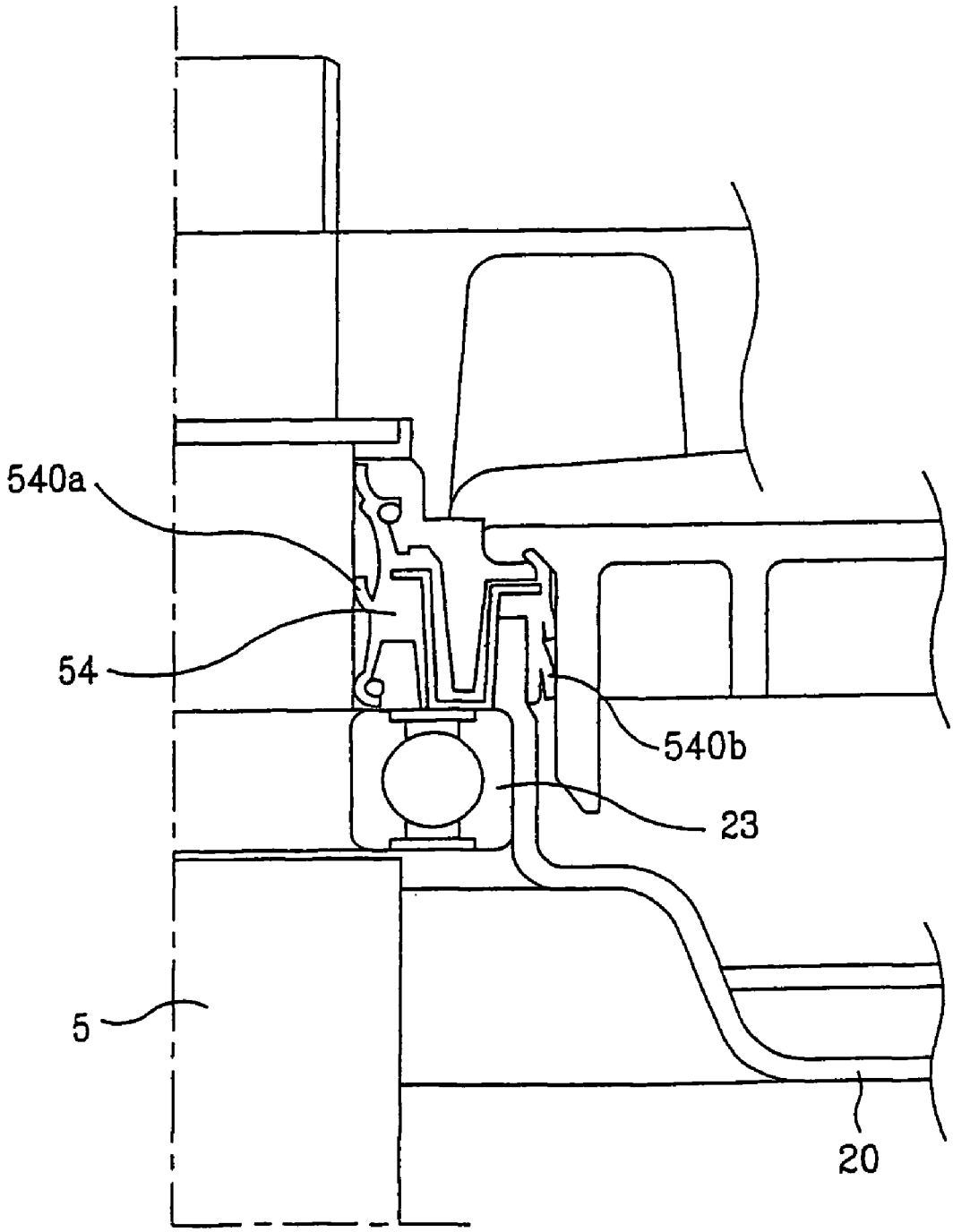
FIG. 9 illustrates an enlarged view of A part in FIG. 5A.

FIG. 9 illustrates an enlarged view of A part in FIG. 5A.

There is a sealing member 54 in the upper part of the upper shaft holding bearing 23 which holds the spinning shaft 5 for sealing between the spinning shaft 5 and the shaft holding bearing case 20. The sealing member 54 has at least four lips 540*a* fitted to an inside thereof and at least three lips 540*b* fitted to an outside thereof, for securing a sealing reliability.

Figure 10:
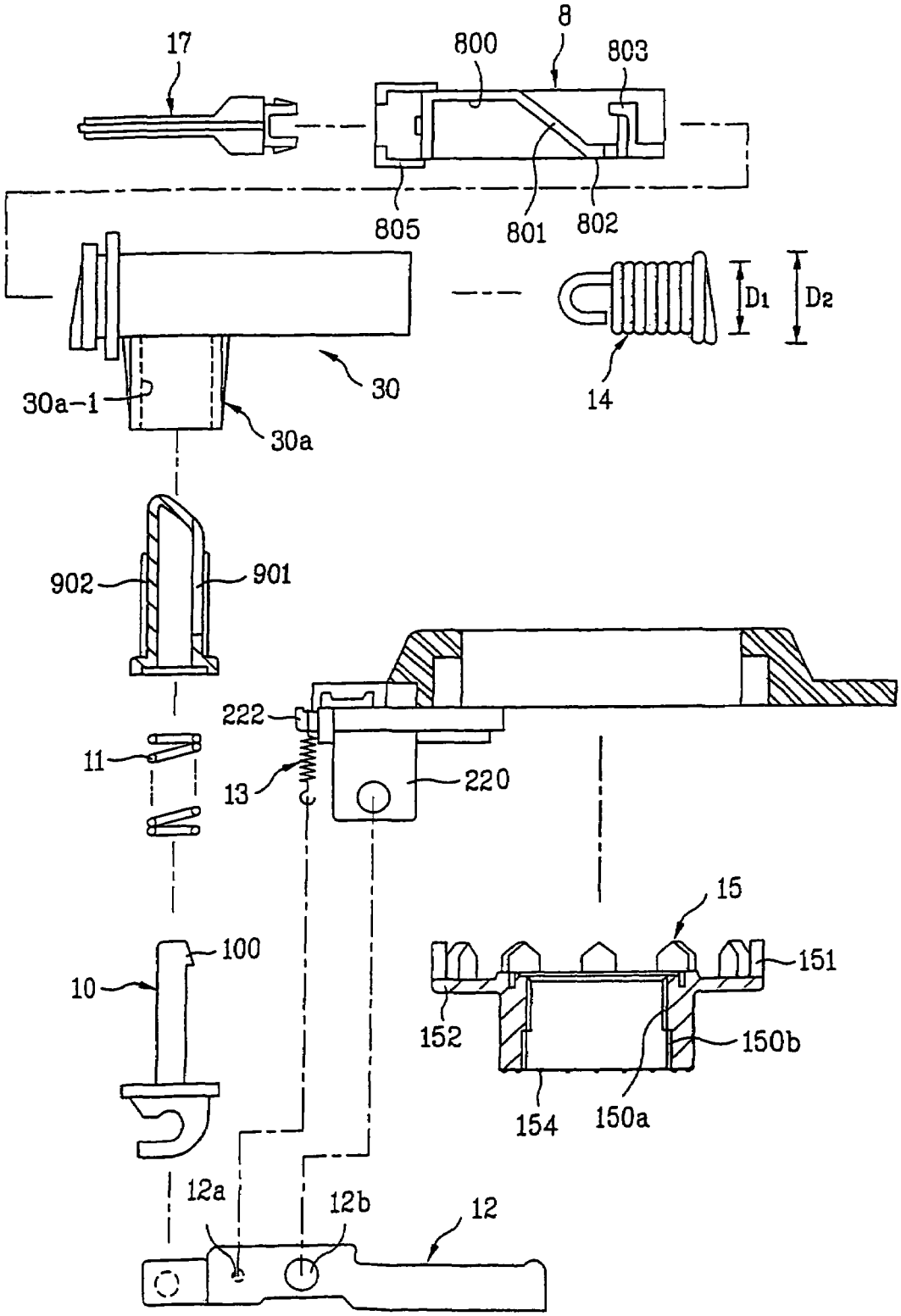
FIG. 10 illustrates a state before assembly of power transmission components for transmission of power from a clutch motor to a coupling, of a clutch mechanism in accordance with a second preferred embodiment of the present invention.
Figure 11:
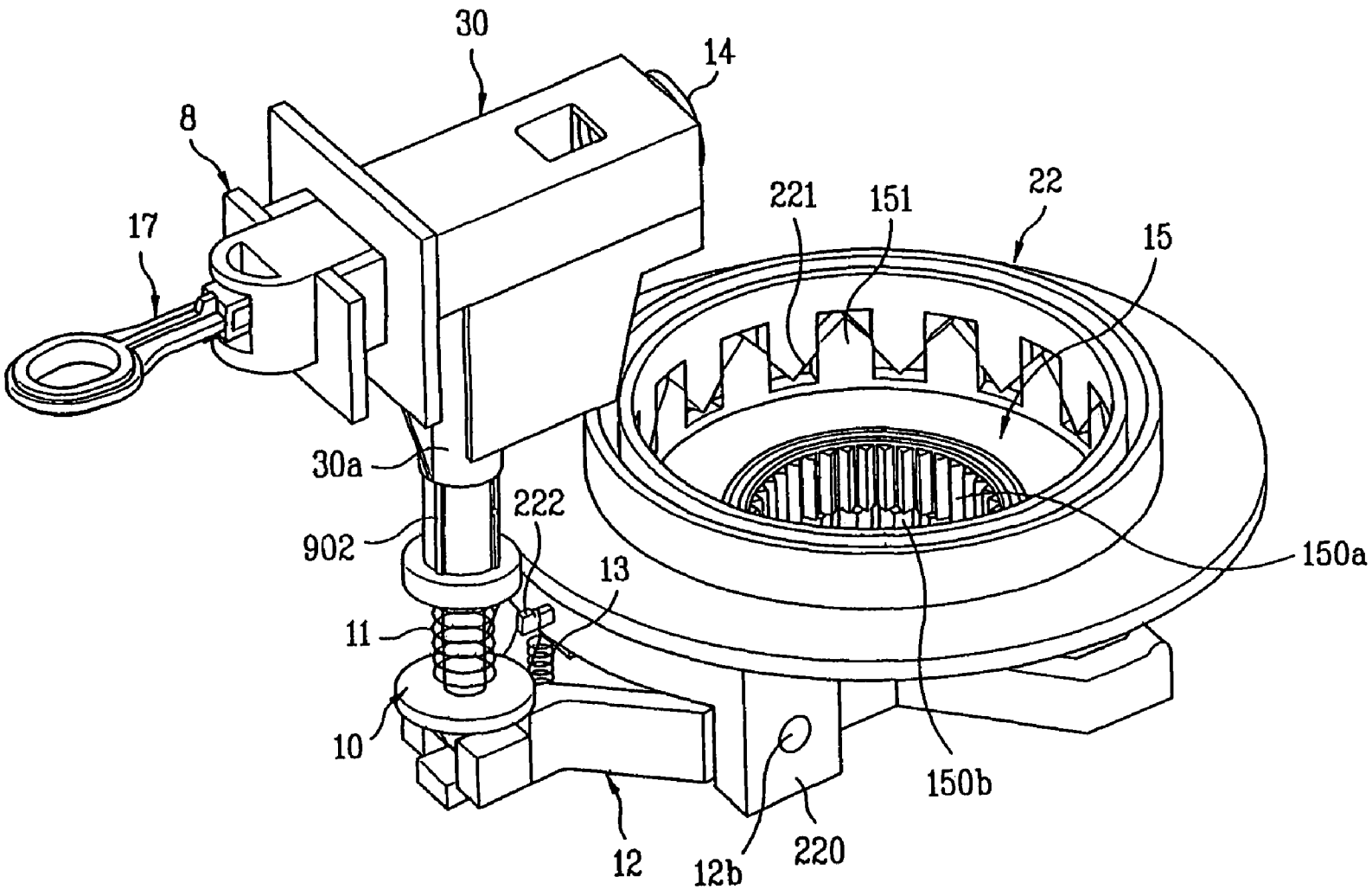
FIG. 11 illustrates a perspective view of a state after assembly of one in FIG. 10.

FIG. 10 illustrates a section for explaining a process for assembling key parts of a clutch mechanism in accordance with a second preferred embodiment of the present invention, and FIG. 11 illustrates a perspective view of a state after assembly of one in FIG. 10.

The plunger 10, to be inserted in the mover 9, has a projection 101 from an outside circumference of an upper part thereof for preventing the plunger 10 from falling off the mover 9 when the plunger 10 and the mover 9 are assembled with the buffer spring 11 inserted between the plunger 10 and the mover 9.

That is, since the plunger 10, to be inserted in the mover 9, has a radial direction projection 101 from an outside circumference of an upper part thereof, if the plunger 10 is pressed into the mover 9 in a state the compression spring, the buffer spring 11, is inserted in an outside circumferential surface of the plunger 10, such that the projection 101 from the plunger 10 is inserted in a guide long hole 901 formed in one side of an outside circumferential surface of the mover 9, the falling off of the plunger 10 from the mover 9 can be prevented, as a lower end of the projection 101 is caught at a lower end of the guide long hole 901 in the mover 9 even if the mover 9 is pushed upward by a restoring force of the buffer spring 11.

The mover 9 has guide ribs 902 on an outside circumferential surface thereof each extended along an axis direction, and the lever guide 30, the mover 9 is to be inserted therein, has guide grooves 30*a*-1 in an inside circumferential surface of a guide part 30*a* formed to fit to the guide ribs 902 for guiding linear movement of the mover 9.

The mover 9 has a sloped surface at a top part thereof in correspondence to the sloped surface 801 of the lever 8, for making the mover 9 to move in a vertical direction when the lever 8 moves in a horizontal direction.

Along with this, the return spring 14 has one end in a form of a hook for hooking a hooking projection 803 of the lever 8, and the other end wound to a larger diameter D2 than the other part of diameter D1 for being caught at a rear end of the lever guide 30, and thereby fixing a position of the return spring 14.

The connecting rod 17 has one end coupled with the cam 600, and the other end hinge coupled with the lever 8, and there is stopper 805 at a bottom of one end of the lever 8, the connecting rod is coupled thereto, for defining an insertion position of the lever 8 in the lever guide when a restoration force of the return spring 14 is applied thereto.

Referring to FIGS. 5A and 5B, there is a compression spring 40 between the top surface of the coupling 15 and the lower shaft holding bearing 24, for pushing the coupling 15 downward in switching to a spining mode.

Referring to FIGS. 5A-6B, 10, and 11, there is a projection 222 from an outer side of the coupling stopper 22 to be positioned between the plunger 10 and the support bracket 220 of the coupling stopper 22. There is a connecting part 12*a* on the fork form of movable rod 12 right under the projection 222 for connecting both rods in a transverse direction. There is a tension spring 13*b* between the projection 222 and the connecting part 12*a* for providing a rotation force so that the movable rod 12 rotates in a clockwise direction around the fixing pin 12*b*.

A fore end of the movable rod 12 to come into contact with the underside of the flange part 152 of the coupling 15 is rounded for reducing friction.

Figure 12:
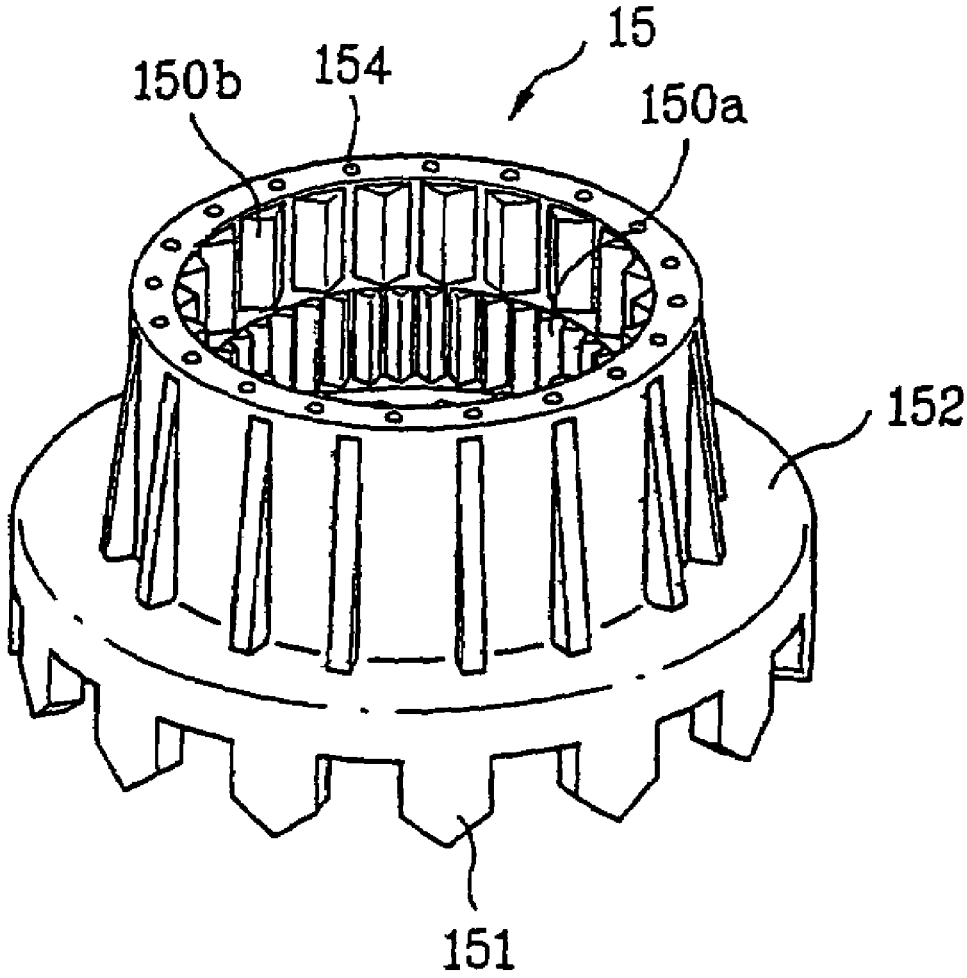
FIG. 12 illustrates a perspective view of a coupling.

FIG. 12 illustrates a perspective view of the coupling 15, including a flange part 152 in an upper part of a cylindrical body thereof extended in a radial direction, gear teeth 151 at an edge of a top surface of the flange part 152 along a circumference thereof for engagement with the gear teeth 221 of the coupling stopper 22, and serrations 150*a*, and 150*b* in an inside surface thereof for engagement with the serration in the spinning shaft 5, and the serration 161*b* in the outside circumferential surface of the upper part of the inner connector 16*b* of the connector assembly 16.

Pitches of the serrations 150*a* and 150*b* in the inside surface of a body of the coupling 15 are made to have different modules from each other, wherein the serrations 150*a*and 150*b* are called as an upper serration 150*a* and a lower serration 150*b* with reference to a top of the inner connector 16*b* at a time the coupling 15 moves down fully, and engages with the inner connector 16*b*.

That is, the pitches of the serrations in the inside surface of a body of the coupling 15 are made such that the module of the serration 150*b* positioned in a lower part with reference to the top of the inner connector 16*b* when engaged is greater.

Particularly, it is preferable that a module ratio of the serration 150*a* in the upper part of the inside of the body of the coupling 15 to the serration 150*b* in a lower part thereof is 1:1.5.

Of the serrations in the inside circumferential surface of the body of the coupling 15, lower ends of the serration 150*b* in the lower side having a greater pitch are rounded for easy engagement/disengagement with the serration 161*b* in the inner connector 16*b*.

Particularly, the lower ends of the rounded lower side serration 150*b* are rounded to be involute profile surfaces for easy clutching with the serration of the inner connector 16*b*.

A region lower ends of the upper side serration 150*a* and bottom lands of the lower side serration 150*b* are met therein is rounded to reduce rapid sectional area transition for increasing a strength against a torsional stress.

Along with these, there are a plurality of projections 154 from a lower end of the body of the coupling 15 along a circumference thereof.

Figure 13:
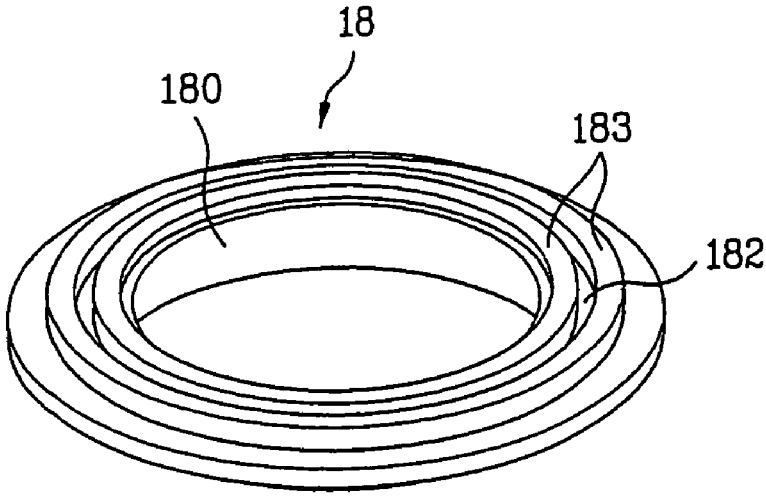
FIG. 13 illustrates a perspective view of a rubber ring.
Figure 14:
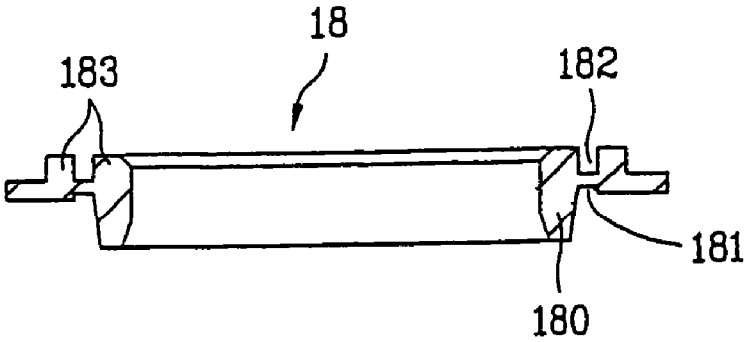
FIG. 14 illustrates a section of one in FIG. 13.

That is, the projections 154 from a lower end of the body of the coupling 15 along a circumference thereof serve to reduce a contact area of the coupling. 15 with the rubber ring 18, the elastic member, seated in the elastic member seat 162*a* in the outer connector 16*a* FIG. 13 illustrates a perspective view of a rubber ring, and FIG. 14 illustrates a section of one in FIG. 13.

Referring to the drawings, the rubber ring 18 includes an elastic rib 180 under an inside ring thereof having a dimension slightly smaller than an outside diameter of the inner connector 16*b*, an annular groove 181 in a lower surface thereof on an outer side, and in a radial direction of the elastic rib 180, for providing an allowance of radial direction deformation of the elastic rib 180, and a groove 182 in a part in contact with the underside of the coupling 15 on the rubber ring for preventing the rubber ring from sticking to the underside of the coupling 15, and moving together with the coupling 15, and providing a cushion.

The groove 182 in the upper surface of the coupling 15 is formed by annular ribs 183 spaced in a radial direction.

The operation of the foregoing clutch mechanism in accordance with a second preferred embodiment of the present invention will be explained.

Before the washing is started, the clutch mechanism in accordance with a second preferred embodiment of the present invention is in a turned off state when no power is provided to the clutch motor 6, when the coupling 15 is in a moved down state as shown in FIGS. 5B and 6B.

That is, in this instance, the mover 9 rests in the recess 800 with the sloped surface 801 of the lever 8, and the coupling 15 is at the lowest position.

Under this state, when power is provided to the clutch motor 6, to turn on the clutch motor 6, a driving force is provided from the clutch motor 6 to the cam 600 through the driving shaft 602, the connecting rod 17 moves toward the clutch motor 6 as the cam 600 rotates, and, according to this, the lever 8, guided by the lever guide 30, is pulled toward the clutch motor 6.

In this instance, the return spring 14 at the rear end of the lever guide 30 is pulled.

In the meantime, the mover 9, brought into contact with the sloped surface 801 of the lever 8 when the cam 600 rotates, is pushed down, to move down, such that the mover 9 is under the flat surface 802 of the lever 8 as shown in FIGS. 5A and 6A at the time the cam 600 is at a holding point as shown in FIG. 7A.

Thus, when the cam 600 rotates to the holding point, with subsequent move down of the mover 9 following movement of the lever 8 toward the clutch motor, the mover 9 presses the buffer spring 11 to move the plunger 10, fitted movable along the guide groove 900 in the mover 9, down too.

Then, as the plunger 10 moves down, the movable rod 12, hinge coupled to the plunger 10, rotates in a counter clockwise direction when the drawing is seen from above around the fixing pin 12*b* at the one point of the intermediate part passing through the support bracket 220 of the coupling stopper 22 fixed to the underside of the shaft holding bearing case 20.

When the movable rod 12 rotates in the counter clockwise direction when the drawing is seen from above around the fixing pin 12*b*, the fore end of the movable rod 12 comes into contact with the underside of the flange part 152 of the coupling. 15, and pushes the coupling 15 upward along the spinning shaft 5 toward an upper part of the shaft.

As a result, as shown in FIGS. 5A and 6B, when the power switching to the washing mode is finished, the gear teeth 151 on the top part of the coupling 15 come to engage with the gear teeth 221 in the coupling stopper 22 fixed to the underside of the shaft holding bearing case 20.

Once the gear teeth 151 of the coupling 15 engages with the gear teeth 221 of the coupling stopper 22, the coupling 15 decouples from the connector assembly 16, allowing rotation of the washing shaft 4 only, when the rotor 7*b* rotates.

That is, in washing, since the coupling 15 is engaged only with the serration in the outside circumference of the spinning shaft 5, and the inner connector 16*b* engaged with the washing shaft 4 is not engaged with the serration in the upper part of the inner connector 16*b*, the rotating power of the rotor 7*b* is transmitted only to the pulsator 3 through the washing shaft 4.

In a state the teeth 151 of the coupling 15 is engaged with the gear teeth 221 of the coupling stopper 22, rotation of the coupling 15 is prevented by the gear teeth 221 of the coupling stopper 22.

The turned off state of the clutch motor 6 held when the washing machine is switched to the washing mode to progress washing is made available by the system and operation of the clutch motor of the present invention. The system and operation of the clutch motor of the present invention which can hold a position of the cam 600 even in a turned off state will be explained in detail, later.

The operation of the clutch mechanism in spinning will be explained.

While the washing is progressed in a state as shown in FIGS. 5A or 6A, if it is required to switch the power transmission path to a spinning mode for progressing spinning as the washing is finished, power is provided to the clutch motor 6 again, to drive the clutch motor for rotating the cam 600.

When the cam 600 of the clutch motor 6 rotates to a spinning position, the lever 8 moves away from the clutch motor 6 by the restoration force of the return spring 14.

According to this, the mover 9, in contact with the flat surface 802 of the lever 8 in the washing mode, rests in the recess 800 with the sloped surface 801 of the lever 8 at a time the restoration of the lever 8 is finished as shown in FIGS. 5B and 6B.

When the mover 9 thus moves up following the movement of the lever 8, the pressure on the buffer spring 11 is eased, such that the plunger 10, movably fitted along the guide grooves 900 in the mover 9, also moves up.

Then, as the plunger 10 moves up, the movable rod 12 hinge coupled to the plunger 10 rotates in a clockwise direction when the drawing is seen from above around the fixing pin 12*b* fitted to pass through the support bracket 220 of the coupling stopper 22 fixed to the underside of the shaft holding bearing case 20 (see. FIGS. 5A and 6A).

Thus, as the movable rod 12 rotates in the clockwise direction when the drawing is seen from above around the fixing pin 12*b*, the force of the fore end of the movable rod. 12, pushing up the coupling 15 in a shaft upper part direction along the spinning shaft 5, is removed.

As the supporting force of the movable rod 12 to the coupling 15 is removed, the coupling 15 moves down by gravity and the restoration force of the compression spring 40, to disengage the gear teeth 151 of the coupling 15 from the gear teeth 221 of the coupling stopper 22.

When the coupling 15 moves down fully, the serrations 150*a* and 150*b* in the inside circumferential surface of the coupling 15 respectively engage with the serration 161*b* in the outside circumferential surface of the upper part of the inner connector 16*b* coupled to the washing shaft 4, and the serration in the lower part of the spinning shaft 5, such that both the washing shaft 4 and the spinning shaft 5 rotate at a high speed when the rotor 7*b* rotates at a high speed, to progress the spinning.

Of the serrations 150*a* and 150*b* in the inside circumferential surface of the coupling 15, since the serration 150*b* to be engaged with the inner connector 16*b* is formed to have a greater module, and the lower ends of the serration 150*b* in the lower side having a greater pitch are rounded, engagement/disengagement of the inner connector 16*b* with the serration 161*b* is made easy.

Particularly, since the lower ends of the rounded lower side serration 150*b* of the coupling 15 is formed to be involute profile surfaces, clutching/declutching of the inner connector 16*b* with the serration 161*b* is made easier.

Moreover, since a region lower ends of the upper side serration 150*a* and bottom lands of the lower side serration 150*b* in the inside circumferential surface of the body of the coupling 15 are met therein is rounded to reduce rapid sectional area transition, a strength of the serration of the coupling 15 against a torsional stress is increased.

Meanwhile, when the engagement of the gear teeth 221 of the coupling stopper 22 with the gear teeth 151 of the coupling 15 is failed, there may be a state of momentary seizure of the coupling 15 occurred in a power switching to a washing mode to proceed to a washing by driving the clutch motor 6 to drive the washing coupling 15 to the washing position.

That is, though positions of the gear teeth 221 are fixed as the coupling stopper 22 is fixed to the shaft holding bearing case 20, positions of the gear teeth 151 vary when the gear teeth are standstill as the coupling 15 is rotatable with the spinning shaft 5.

According to this, in switching to washing, there may be a case when crests of the gear teeth of the coupling 15 and crests of the gear teeth 221 of the coupling stopper 22 abut, which is called as a momentary seizure of the coupling 15.

In this instance, the coupling 15, slightly engaged with the serration 161*b* in the outside circumferential surface of the upper part of the inner connector 16*b*, rotates until the crests of the coupling and spaces of the teeth of the inner connector meet, when the gear teeth 151 of the coupling 15 and the gear teeth 221 of the coupling stopper 22 engage smoothly as the buffer spring 11 between the mover 9 and the plunger 10 in the clutch mechanism of the present invention pushes, to free the momentary seizure of the coupling 15.

Instead of the formation of the serration in the lower part of the washing shaft 4, the lower part of the washing shaft is formed to be square, and the inside of the inner connector 16*b* is formed to be a square hollow fit to the square shaft, so that the square shaft and the square hollow are shaft coupled.

Though the foregoing second embodiment shows a case when the connecting rod 17 and the lever 8 are hinge coupled, if the coupling of the connecting rod 17 with the lever 8 is not the hinge coupling, it is required that the connecting rod is formed of a flexible material.

Figure 15:
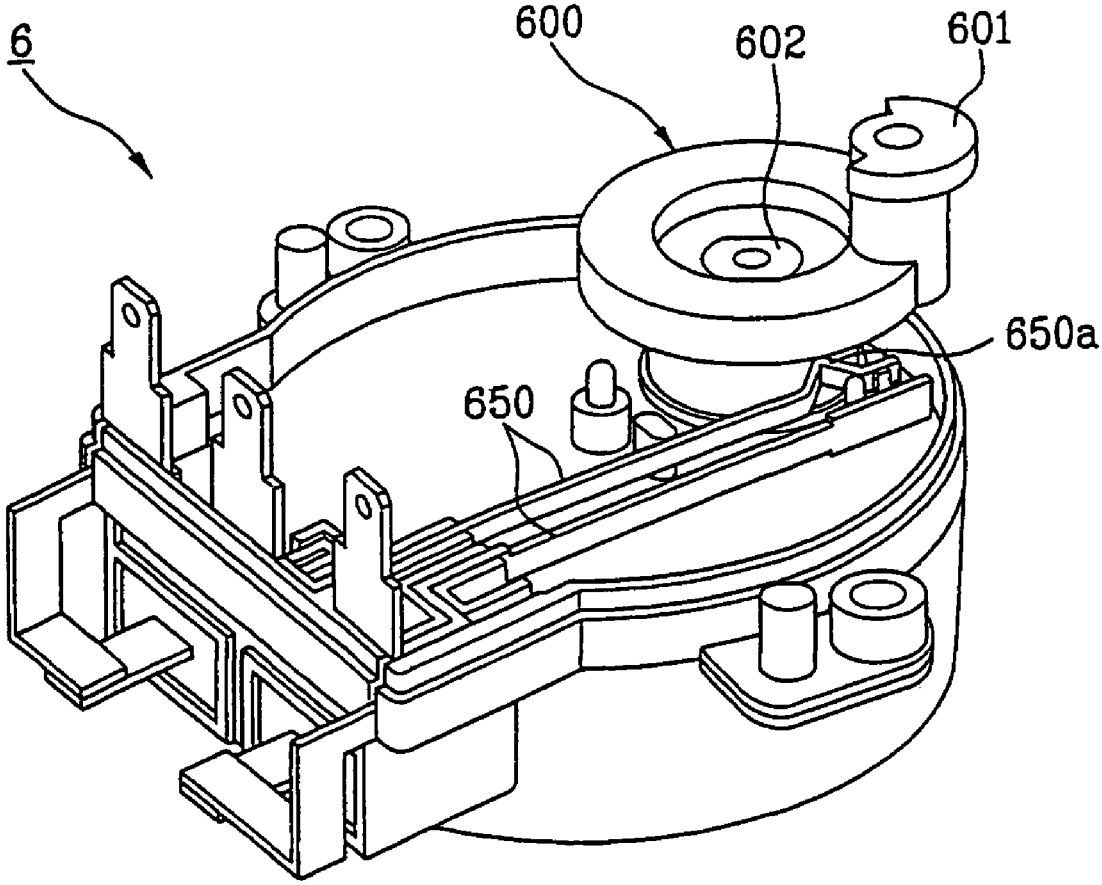
FIG. 15 illustrates a perspective view of a clutch motor.
Figure 16:
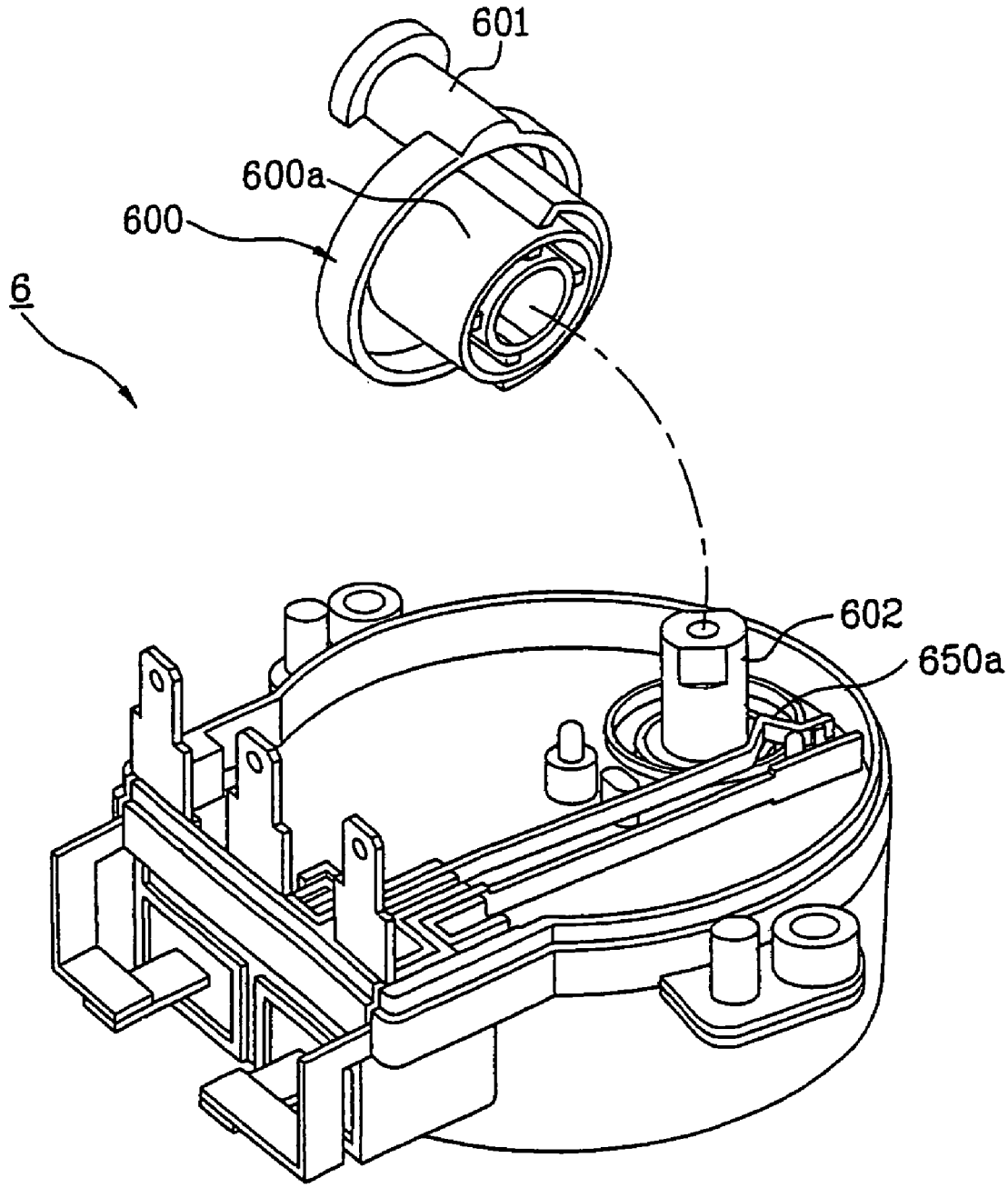
FIG. 16 illustrates a disassembled perspective view of one in FIG. 13.

The clutch motor applied to the first, or second embodiment of the present invention will be explained. FIG. 15 illustrates a perspective view of a clutch motor, and FIG. 16 illustrates a disassembled perspective view of one in FIG. 13, referring to which a structure and operation of the clutch motor of the present invention will be explained.

The clutch motor 6 of the present invention has the cam 600 directly coupled to the driving shaft 602, such that the cam 600 rotates at an angular speed the same as the driving shaft 602, and the cam 600 also stops at a position the driving shaft 602 stops.

For reference, the clutch motor 6 of the present invention, a modified version of a drain motor used in general for driving a drain valve, has an identical motor driving part system, inclusive of the rotor and the stator.

However, while the drain motor used for driving the drain valve, having a spring between the cam and the driving shaft to allow a certain extent of slip, has a quick return action in which the cam returns quickly when the drain motor is turned off, the clutch motor 6 of the present invention, being an assembled structure having no slip between the cam 600 and the driving shaft 602 at all, prevents the quick return, and has a range of cam groove formation angle in the cam 600 different from the related art drain motor cam.

The formation angle of the cam groove in the cam 600 of the clutch motor of the present invention may be set within a range of 90 degrees to 250 degrees, and preferably within a range of 180 degree to 210 degrees.

In the clutch motor 6 of the present invention, the cam 600 can not rotate as far as the driving shaft does not rotate. Since the quick return of cam 600 is prevented even when the clutch motor 6 is turned off due to a torque required for rotation of the driving shaft greater and a restoration force of the return spring 14, noise of impact caused by the quick return of the coupling 15, the lever 8, and the like is prevented, implementing low noise in clutch operation.

Moreover, the clutch motor 6 of the present invention requires no sustaining power in carrying out a macerating course, or the like, that takes a long time period, since the cam 600 also stops at a position the driving shaft 602 stops.

In the meantime, FIGS. 17A-17C illustrate operative relations of a driving cam and a switch in a clutch motor of the present invention schematically, wherein FIG. 17A illustrates a cam and switch state at a washing mode holding point, FIG. 17B illustrates a cam and switch state just before switching to a spinning mode, and FIG. 17C illustrates a cam and switch state at an initial point. FIG. 18 illustrates a timing diagram showing operative relations between a clutch motor, cam, and switch in the present invention. Referring to the foregoing drawings, the operative relations of the cam and the switch of the clutch motor will be explained.

In a state the cam 600 is at an initial point, the switch 650 is in a turned off state. The state the cam 600 is at an initial point is a state a rod connecting shaft 601 of the cam 600 is directed to an initial point.

Under this state, when the power transmission path is switched for washing, the clutch motor 6 is turned on, to rotate the cam 600 in a clockwise direction. Since a projection 650*a* of the switch 650 is on the cam groove surface 600*a* until the rotation angle of the cam 600 reaches to a preset angle (for an example, 150 degrees) from the initial point, the switch 650 is in a turned off state.

When the rotation angle of the cam 600 reaches to a preset angle (for an example, 150 degrees) from the initial point, the switch 650 is turned on as the projection 650*a* of the switch 650 comes out of the cam groove surface 600*a* of the cam 600.

Thus, when the cam 600 reaches to a preset rotation angle from the initial point, the crests of the gear teeth 151 of the coupling 15 and the crests of the gear teeth 221 of the coupling stopper 22 start to engage with each other.

However, even after this, a turn on state of the clutch motor 6 is continued until the cam 600 reaches to a point 170 degrees from the initial point as shown in FIG. 17A, when the clutch motor 6 is turned off. Thus, the clutch motor 6 is turned off at a holding point of the cam 600 for more positive power switching to the washing mode.

In the maintenance of the turn on state of the clutch motor 6 from a time point right after the switch is turned on to a time point the cam 600 reaches to the holding point, which is made by a time control, a turn on state maintenance time period of the clutch motor 6 can be calculated by dividing a-rotation angle (i.e., 20 degrees) from a switch 650 turn on point to the holding point with one rotation period, since the one rotation period of the clutch motor 6 is constant.

In the meantime, for spinning after finishing the washing, it is required that the cam 600 is returned to the initial point.

For this, in the power switching to the spinning mode, the clutch motor 6 is turned on again to turn the cam 600 in the clockwise direction, when the switch is in a turned on state until the cam 600 passes a point (a point 158 degrees from the holding point in the clockwise direction) 328 degrees from the initial point in the clockwise direction when the projection 650*a* of the switch 650 is on the cam groove surface 600*a*, to turn the switch 650 off as contact points thereof come apart (see FIG. 17B).

Even if the switch 650 is turned off, the clutch motor 6 is maintained to be in a turned on state until the cam 600 reaches to the initial point by a microcomputer, when the switch 650 is turned off.

In the maintenance of the turn on state of the clutch motor 6 from a time point right after the switch is turned off to a time point the cam 600 reaches to the initial point, which is made by a time control, a turn on state maintenance time period of the clutch motor 6 can be calculated by dividing a rotation angle (i.e., 32 degrees) from a switch 650 turn off point to the initial point with one rotation period, since one rotation period of the clutch motor 6 is constant.

In the meantime, in the state the cam 600 is at the initial point as explained above, because not only the engagement of the gear teeth 151 of the coupling 15 and the gear teeth 221 of the coupling stopper 22 is disengaged, but also the upper serration 150*a* and the lower serration 150*b* in the inside circumferential surface of the coupling 15 respectively engage with the serration 161*b* in the outside circumferential surface of the upper part of the inner connector 16*b* to be coupled to the washing shaft 4 and the serration in the lower part of the spinning shaft 5 on the same time, the washing shaft 4 and the spinning shaft 5 rotate simultaneously, to make water extraction.

A process of decoupling of the coupling to be made before and after the switching to washing or spinning mode will be explained, with reference to FIGS. 19 and 20. FIG. 19 illustrates a timing diagram showing operation of a BLDC motor and a clutch motor at an initial stage of washing in a washing machine in accordance with a preferred embodiment of the present invention, referring to which the decoupling of the coupling 15 to be made before and after the switching from the spinning mode to the washing mode will be explained.

In starting the coupling to move up for washing after water is supplied, moving up of the coupling 15 may be seized since the serrations 150*a* and 150*b* in the inside circumferential surface of the coupling 15 receive opposite facial pressures from the serration in the lower part of the spinning shaft 5 and the serration 161*b* in the upper part of the inner connector 16*b* as the spinning shaft 5 and the inner connector 16*b* engaged with the coupling 15 set in opposite directions in a previous stop.

Consequently, in the present invention, the step for alternating rotation of the BLDC motor 7 is carried out, for preventing the seize of the upward movement of the coupling 15, before carrying out the step of moving up the coupling 15 to the washing mode position by turning on the clutch motor 6 after the water supply for washing.

That is, before putting the clutch motor 6 into operation for switching to the washing mode, rotation direction of the BLDC motor 7 is alternated for a time period at rotation angles smaller than a rotation angle in the washing.

Just before a main washing is carried out after finishing the switching to the washing mode by driving the clutch motor 6, the rotation direction of the BLDC motor 7 is also alternated for a time period at short intervals before the main washing having regular reversing periods is carried out for prevention of overload on the system at an initial stage of washing.

A process of decoupling of the coupling to be made before and after the switching from the washing mode to the spinning mode will be explained, with reference to FIG. 20.

FIG. 20 illustrates a timing diagram showing operation of a BLDC motor and a clutch motor at finish of washing and at an initial stage of spinning in a washing machine in accordance with a preferred embodiment of the present invention. In switching to the spinning mode after the washing is finished, move down of the coupling 15 may be seized when the clutch motor 6 is put into operation because there may be opposite facial pressures to the gear teeth 151 of the coupling 15 and the gear teeth 221 of the coupling stopper 22 caused by setting of the coupling 15 to the coupling stopper 22 in a seized state in the previous stop.

Consequently, in the present invention, the step of alternating a rotation direction of the BLDC motor 7 is carried out for releasing the coupling 15 from the seizure just before the step of moving down the coupling 15 to the spinning mode position is carried out by turning on the clutch motor 6 for switching to the spinning mode after finishing the washing.

In this instance, the BLDC motor 7 is controlled to alternate a rotation direction for a time period at rotation angles smaller than a rotation angle in washing.

After the rotation direction of the BLDC motor 7 is alternated for a time period at short time intervals, for making a more reliable engagement of the coupling 15 with the inner connector 16*b* just before a main spinning is carried out after finishing the switching to the spinning mode, a regular spinning is carried out.

A process for controlling the clutch motor for carrying out the washing, or spinning will be explained, with reference to FIGS. 21 and 22. FIG. 21 illustrates a flow chart showing the steps of a process for controlling a clutch motor in change over of a washing mode in accordance with a preferred embodiment of the present invention, and FIG. 22 illustrates a flow chart showing the steps of a process for controlling a clutch motor in change over of a spining mode in accordance with a preferred embodiment of the present invention.

A process for controlling a clutch motor for carrying out the washing will be explained, with reference to FIG. 21, at first.

Upon entering into the washing mode, water is supplied for the washing (a first step), when the cam 600 of the clutch motor is at the initial point, with the switch 650 in a turned off state.

After the water supplied is finished, the clutch motor 6 is turned on, to rotate the cam 600 (a second step), and, on the same time with this, a time period is counted (a third step).

Then, attainment of change to a turned on state of the switch 650 of the clutch motor 6 within a preset time period following rotation of the cam 600 is checked continuously starting from the time counting (step 4).

In a case when the change to a turned on state of the switch 650 of the clutch motor 6 within a preset time period is attained, a number of pulses are counted right after the change to the turned on state of the switch 650 (step 5).

Then, reach of a counted pulse number to a preset pulse number is determined (step 6), and, when the number of pulses is reached to the preset pulse number as a result of the determination, the clutch motor 6 is turned off for holding a cam position (step 7). In this instance, the cam 600 is at a setting point for carrying out the washing mode.

On the contrary to this, as a result of carrying out the step of checking the attainment of change to a turned on state of the switch 650 of the clutch motor 6 within a preset time period following rotation of the cam (step 4), in a case the change to a turned on state of the switch 650 is not attained even if the preset time period is exceeded, the clutch motor 6 is turned off (step 8), and a rotation direction of the BLDC motor is alternated for a time period at short intervals, to make a seizure releasing action (step 9).

A number of the seizure releasing actions made by the BLDC motor 7 is checked (step 10), to return to the step 2 to turn on the clutch motor 6 again to drive the cam 600 when the number of the seizure releasing actions made by the BLDC motor 7 is failed to reach to the preset number of seizure releasing actions (step 11), and, contrary to this, if the number of the seizure releasing actions made by the BLDC motor 7 is reached to the preset number of seizure releasing actions, an error is displayed on a display part (not shown), and the washing machine is stopped (step 12).

In the foregoing process, it is preferable that a time period required for changing the switch 650 in the clutch motor 6 to the turned on state, when the clutch motor 6 is turned on after the water supply is finished, is set to be within five seconds for application to 50 Hz or 60 Hz of a frequency of a rated voltage provided to the clutch motor 6 in common. That is, a time period required for rotating the cam 600 of the clutch motor 6 one turn is set to be 12 seconds when the frequency is 50 Hz, and 10 seconds when the frequency is 60 Hz due to a speed reduction by a reduction gear in the clutch motor 6. If the rotation angle of the cam 600 from the initial point to the point the switch 650 in the clutch motor 6 turns off is, for an example, 150 degrees, the time period required for changing the switch 650 in the clutch motor 6 to the turned on state is set to be five second, for application both to 50 Hz case, and 60 Hz for rotation as much as this angle.

Of course, the time period required for one turn of the cam 600 is applicable to a process for controlling the clutch motor 6 in spinning, explained later.

A process for controlling the clutch motor 6 in carrying out spinning will be explained, with reference to FIG. 22.

When the washing is finished, the clutch motor 6 is in a turned off state, and the switch 650 in the clutch motor 6 is in a turned on state as the cam 600 is at the washing holding point.

Therefore, in switching to the spinning mode, the clutch motor 6 is turned on to rotate the cam 600 at first in a state the switch 650 is turned on when the cam 600 of the clutch motor 6 is at the holding point (step 1), and, on the same time with this, a time period is counted (step 2).

Then, attainment of change to a turned off state of the switch 650 of the clutch motor 6 within a preset time period following rotation of the cam 600 is checked continuously starting from the time counting (step 3).

In a case when the change to a turned off state of the switch 650 of the clutch motor 6 within a preset time period is attained, a driving time of the clutch motor 6 is counted newly starting from a time right after the change of the switch 650 to the turned off state (step 4).

Then, reach of a counted driving time of the clutch motor 6 to a preset time is determined (step 5), and, when the newly counted driving time period of the clutch motor 6 starting from a time right after the change of the switch 650 to the turned off state is reached to the preset time period as a result of the determination, the clutch motor 6 is turned off for holding a cam position at the initial point (step 6).

On the contrary to this, as a result of checking in the step 3 in the foregoing controlling, in a case the change to a turned off state of the switch 650 is not attained even if the preset time period is exceeded, the clutch motor 6 is turned off (step 7), and a rotation direction of the BLDC motor is alternated for a time period at short intervals, to make a seizure releasing action (step 8).

A number of the seizure releasing actions made by the BLDC motor 7 is checked (step 9), to return to the step 1 to turn on the clutch motor 6 again to drive the cam 600 when the number of the seizure releasing actions made by the BLDC motor 7 is failed to reach to the preset number of seizure releasing actions (step 10), and, contrary to this, if the number of the seizure releasing actions made by the BLDC motor 7 is reached to the preset number of seizure releasing actions, an error is displayed, and the washing machine is stopped (step 11).

In the foregoing process, when the clutch motor 6 is turned on for switching to the spinning mode, it is preferable that a time period required for switching the switch 650 in the clutch motor 6 to the turned off state is set to be within seven seconds for application to 50 Hz or 60 Hz of a frequency of a rated voltage provided to the clutch motor 6 in common. That is, a time period required for rotating the cam 600 of the clutch motor 6 one turn is set to be 12 seconds when the frequency is 50 Hz, and 10 seconds when the frequency is 60 Hz due to a speed reduction by a reduction gear in the clutch motor 6. If the rotation angle of the cam 600 from the holding point to the point the switch 650 in the clutch motor 6 turns off is 158 degrees, the time period required for changing the switch 650 in the clutch motor 6 to the turned off state is set to be seven seconds, for application both to 50 Hz case, and 60 Hz case for rotation as much as this angle.

A control process for initializing the clutch motor 6 in cases power is provided again after black out, or a power plug is fallen off, to fail in providing power to the washing machine, will be explained, with reference to FIG. 23.

This clutch motor 6 initializing process is required because, when the power is failed in the middle of rotation of the cam 600 as the clutch motor 6 is turned on for switching to the washing mode, or the spinning mode, there may be a case the cam 600 of the clutch motor 6 rests at, not the initial point or the holding point, but other point, to fail a regular progress of the washing or the spinning cycle if the power to the washing machine is turned on again in above state to turn on the clutch motor again, since control of the clutch motor 6 is made in a state no seizure of the coupling is detected and no seizure releasing action is made even if the coupling is seized.

Accordingly, the present invention facilitates to make regular switching to the washing mode or the spinning mode by initializing the cam 600 of the clutch motor, such that the cam 600 of the clutch motor always positions at the initial point in the cases power is provided again after black out, or a power plug is fallen off, to fail in providing power to the washing machine, of which detailed initializing process of the clutch motor 6 will be explained.

FIG. 23 illustrates a flow chart showing the steps of a process for initializing a clutch motor in accordance with a preferred embodiment of the present invention.

Referring to FIG. 23, when a power switch (not shown) is turned on newly (step 1), turn on/off of the switch 650 inside of the clutch motor 6 is detected at a time point the power switch is turned on (step 2).

As a result of the detection in above step, if the switch 650 inside of the clutch motor 6 is in a turned on state, the clutch motor 6 is turned on, to rotate the cam 600 (step 3). Time is counted on the same time with the turning on of the clutch motor 6 (step 4).

Change of the clutch motor 6 to the switch 650 off state within a preset time period is made is checked continuously starting from a time the time is counted (step 5).

In a case when it is checked that the change of the clutch motor 6 to the switch 650 off state is made within a preset time period, a driving time of the clutch motor 6 is counted newly, starting from a time point right after the switch off (step 6).

Then, reach of a counted driving time period of the clutch motor 6 to a preset time period is determined (step 7), and the clutch motor 6 is turned off to hold the cam at the initial point (step 8) in a case the clutch motor 6 driving time period counted newly starting from a time point right after the switch off reaches to the preset time period.

In the foregoing control, when the switch 650 is not changed to a turned on state even if the preset time period is exceeded in the step 5, the clutch motor 6 is turned off (step 9), and direction of rotation of the BLDC motor 7 alternates for a time period at short intervals, for carrying of a seizure releasing actions (step 10).

A number of times of the seizure releasing actions carried out by the BLCD motor 7 are checked (step 11). In a case the number of times of the carried out seizure releasing actions is not reached to the preset number of times of the carried out seizure releasing actions, the process returns back to the step 3, to turn on the clutch motor 6 again to drive the cam 600 (step 12), and, opposite to this, in a case the number of times of the carried out seizure releasing actions is reached to the preset number of times of the carried out seizure releasing actions, an error is displayed, and the washing machine is stopped (step 13).

In the meantime, if the switch 650 inside of the clutch motor 6 is in a turned off state as a result of detection in the step 2, the clutch motor 6 is turned on to rotate the cam 600 (step 14). In this instance, a time period is counted on the same time with the turn on of the clutch motor 6 (step 15).

Change of the clutch motor 6 to the switch 650 on state within a preset time period is made is checked continuously starting from a time the time is counted (step 16). In a case when it is checked that the change of the clutch motor 6 to the switch 650 on state is made within a preset time period, the process returns back to the step 3, and steps thereafter is progressed (step 17).

As a result of the determination in the step 16, when the switch 650 is not changed to a turned on state even if the preset time period is exceeded, the clutch motor 6 is turned off (step 18), and direction of rotation of the BLDC motor 7 alternates for a time period at short intervals, for carrying of a seizure releasing actions (step 19).

A number of times of the seizure releasing actions carried out by the BLCD motor 7 are checked (step 20). In a case the number of times of the carried out seizure releasing actions is not reached to the preset number of times of the carried out seizure releasing actions, the process returns back to the step 14 again, to turn on the clutch motor 6 again to drive the cam 600 (step 21), and, opposite to this, in a case the number of times of the carried out seizure releasing actions is reached to the preset number of times of the carried out seizure releasing actions, an error is displayed, and the washing machine is stopped (step 22).

Thus, the full automatic washing machine of the present invention can always make an exact operation of the clutch motor 6 even if in a power turned off state caused by black out and the like by initializing the clutch motor 6.

VI. INDUSTRIAL APPLICABILITY

As has been explained, the present invention has an advantage in that a stable transmission/switching of a rotating power from a driving part having a stator and a rotor to a pulsator or spinning tub through a washing shaft or a spinning shaft is achieved within a short time period by means of a new driving mechanism.

The present invention implements a high efficiency clutch mechanism since the driving shaft and cam rotate at the same angular speed when the clutch motor is turned on, no restoration action of the cam is required at a time the clutch motor is turned off, removing impact noise caused by the rapid restoration, to permit a low noise power switch, and no sustaining power is required after the power switching to the washing mode, that reduces power consumption.

Together with this, the washing machine of the present invention permits more stable and positive clutching action by alternating a direction of rotation of the BLDC motor before switching to washing or spinning mode for carrying out the switching to the washing or spinning mode in a state seizure of the coupling is released, and, in a case seizure of the clutch motor is occurred in the switching to the washing, or spinning, by putting the clutch motor after detecting the coupling seizure by switching time control of the clutch motor and releasing the seizure again.

Thus, the present invention is very useful for industries.

What is claimed is:

1. A full automatic washing machine comprising:

a spinning tub rotatably fitted to an inside of an outer tub;

a pulsator fitted to an inside of the spinning tub rotatable independent from the spinning tub;

a spinning shaft rotatably held in a shaft holding bearing case for transmission of a rotating power to the spinning tub;

a washing shaft for transmission of the rotating power to the pulsator;

a motor having a stator and a rotor for rotating the rotor by providing an electric power to the stator; and a clutch mechanism for switching a power transmission path from the motor to the washing shaft or the spinning shaft, the clutch mechanism comprising:

a first link member configured to move in a vertical direction;

a second link member coupled with the first link member, wherein the first link member rotates the second link member; and a coupling coupled with the second link member, wherein the coupling is moved along the spinning shaft by the second link member such that the coupling selectively couples the motor to the washing shaft or the spinning shaft.

2. A full automatic washing machine as claimed in claim 1, wherein the clutch mechanism further comprises:

a clutch motor fitted under the outer tub;

a cam coupled with a driving shaft of the clutch motor;

a lever guide fixed to the shaft holding bearing case;

a lever having a recess with a sloped surface, and a flat surface horizontally extended from a lower end of the sloped surface for making a linear movement guided by the lever guide when the clutch motor is turned on/off;

a connecting rod between the cam and lever of the clutch motor for pulling the lever toward the clutch motor side when the clutch motor is turned on;

a return spring having one end fixed to a fore end of the lever guide, and the other end fixed to a fixed projection from one side of the lever, for providing a return force to the lever;

the first link member comprising:

a hollow mover for being brought into contact with the recess with the sloped surface of the lever when the clutch motor is turned off, and moving down along the sloped surface until being positioned under the flat surface when the clutch motor is turned on; and a plunger movable in up and down directions along a guide groove in the mover;

a buffer spring between the mover and the plunger;

the second link member comprising:

a movable rod, the movable rod having one end hinge coupled with a lower end of the plunger;

a coupling stopper fixed to an underside of the shaft holding bearing case having gear teeth formed along a circumference thereof;

a fixed pin fixed to a support bracket of the coupling stopper for serving as a rotation center of the movable rod when the plunger moves up and down;

the coupling switching a rotation power transmission path of the motor while moving up, or down along the spinning shaft depending on a rotation direction of the movable rod; and a connector assembly for transferring a rotation power from the rotor to the washing shaft.

3. A full automatic washing machine as claimed in claim 2, wherein the coupling includes;

gear teeth on a top part thereof to be engaged with the gear teeth on the coupling stopper, and a serration in an inside circumferential surface thereof for engagement with a serration in the spinning shaft or a serration in an outside circumferential surface in the connector assembly.

4. A full automatic washing machine as claimed in claim 2, wherein the connector assembly includes;

an outer connector of a resin fastened to the rotor with fastening members, and an inner connector injection molded of a metal as a unit with the outer connector at an inside thereof having a serration in an inside circumferential surface thereof for engagement with the serration in a lower part of the washing shaft, and a serration in an outside circumferential surface of an upper part thereof exposed to an outside of the outer connector for coupling with the coupling.

5. A full automatic washing machine as claimed in claim 4, wherein the inner connector is formed by an aluminum alloy sintering.

6. A full automatic washing machine as claimed in claim 2, further comprising a compression spring between the top surface of the coupling and the lower shaft holding bearing for pushing the coupling down when the clutch is turned off.

7. A full automatic washing machine as claimed in claim 2, further comprising a stopper on a support bracket of the coupling stopper coupled with the fixed pin for limiting a moving down position of the coupling by limiting a rotation angle of the movable rod.

8. A full automatic washing machine as claimed in claim 2, wherein the clutch mechanism further includes an elastic member for giving a rotation force so that the lever rotates around the fixed pin in a clockwise direction when the clutch motor is turned off.

9. A full automatic washing machine as claimed in claim 8, wherein the elastic member is a torsional spring fitted to the support bracket of the coupling stopper for giving a rotation force such that the lever rotates around the fixed pin in a clockwise direction when the clutch motor is turned off.

10. A full automatic washing machine as claimed in claim 2, wherein the clutch motor is a geared motor for transmitting a power to the cam at a reduced speed through gears.

11. A full automatic washing machine as claimed in claim 10, wherein the cam of the clutch motor is directly coupled to the driving shaft so that the cam is rotated at an angular speed the same with the driving shaft.

12. A full automatic washing machine as claimed in claim 11, wherein the cam has a cam groove within a range of angle in an outside circumferential surface thereof.

13. A full automatic washing machine as claimed in claim 12, wherein the range of angle of the cam groove is 90 degrees to 250 degrees.

14. A full automatic washing machine as claimed in claim 10, wherein the cam has a cam groove within a range of angle in an outside circumferential surface thereof.

15. A full automatic washing machine as claimed in claim 14, wherein the range of angle of the cam groove is 90 degrees to 250 degrees.

16. A full automatic washing machine as claimed in claim 2, wherein the connecting rod has one end coupling to the cam and the other end coupled to the lever.

17. A full automatic washing machine as claimed in claim 2, wherein the connecting rod is formed of a flexible material.

18. A full automatic washing machine as claimed in claim 1, wherein the clutch mechanism further comprises:

a clutch motor fitted under the outer tub;

a cam coupled with a driving shaft of the clutch motor;

a lever guide fixed to the shaft holding bearing case;

a lever having a recess with a sloped surface, and a flat surface horizontally extended from a lower end of the sloped surface for making a linear movement guided by the lever guide when the clutch motor is turned on/off;

a connecting rod between the cam and lever of the clutch motor for pulling the lever toward the clutch motor side when the clutch motor is turned on;

a return spring having one end fixed to a fore end of the lever guide, and the other end fixed to a fixed projection from one side of the lever, for providing a return force to the lever;

the first link member comprising:

a hollow mover for being brought into contact with the recess with the sloped surface of the lever in spinning, and moving down along the sloped surface until being positioned under the flat surface when the mode is switched to washing;

a plunger movable in up and down directions along a guide groove in the mover;

a buffer spring between the mover and the plunger;

a coupling stopper fixed to an underside of the shaft holding bearing case having gear teeth formed along a circumference thereof;

the second link member comprising:

a movable rod having one side fore end hinge coupled with a lower end of the plunger, and one point of an intermediate part thereof hinge coupled with a lower end of a support bracket below the coupling stopper;

the coupling switching a rotation power transmission path of the motor while moving up, or down along the spinning shaft depending on a rotation direction of the movable rod; and a connector assembly for transferring a rotation power from the rotor to the washing shaft.

19. A full automatic washing machine as claimed in claim 18, wherein the clutch motor is a geared motor for transmission of power to a driving shaft connected to the cam at a speed reduced by a reduction gear provided therein.

20. A full automatic washing machine as claimed in claim 19, wherein the clutch motor has a torque required for rotating the driving shaft greater than a return force of the return spring such that the cam stays at a position when the clutch motor is turned off.

21. A full automatic washing machine as claimed in claim 19, wherein the cam of the clutch motor is coupled with the driving shaft directly, for rotation at an angular speed the same with the driving shaft.

22. A full automatic washing machine as claimed in claim 21, wherein the cam has a cam groove within a range of angle in an outside circumferential surface thereof.

23. A full automatic washing machine as claimed in claim 22, wherein the range of angle of the cam groove is 90 degrees to 250 degrees.

24. A full automatic washing machine as claimed in claim 18, wherein the connector assembly includes;

an outer connector of a resin fastened to the rotor with fastening members, and an inner connector injection molded of a metal as a unit with the outer connector at an inside thereof having a serration in an inside circumferential surface thereof for engagement with the serration in a lower part of the washing shaft, and a serration in an outside circumferential surface of an upper part thereof exposed to an outside of the outer connector for coupling with the coupling.

25. A full automatic washing machine as claimed in claim 24, wherein the inner connector is formed by aluminum alloy sintering for improvement of strength.

26. A full automatic washing machine as claimed in claim 24, wherein the outer connector has an annular elastic member seat in a center part of a top surface thereof for seating an elastic member.

27. A full automatic washing machine as claimed in claim 26, wherein the elastic member seated in the elastic member seat in the outer connector is a rubber ring.

28. A full automatic washing machine as claimed in claim 27, wherein the rubber ring includes;

an elastic rib under an inside ring thereof having a dimension slightly smaller than an outside diameter of the inner connector, a projection rib spaced from the elastic rib in a radial direction to form an annular groove in a lower surface thereof on an outer side, and in a radial direction of the elastic rib, for providing an allowance of radial direction deformation of the elastic rib.

29. A full automatic washing machine as claimed in claim 28, wherein the rubber ring further includes a groove in a part in contact with the underside of the coupling on the rubber ring for preventing the rubber ring from sticking to the underside of the coupling, and moving together with the coupling, and providing a cushion.

30. A full automatic washing machine as claimed in claim 24, wherein the spinning shaft includes:

a lower shaft part with a large inside diameter, an upper shaft part press fit inside of an upper part of the lower shaft part 5*b*, and an upper part of the lower shaft part held by the upper shaft holding bearing which holds the spinning shaft.

31. A full automatic washing machine as claimed in claim 30, wherein there is a gap provided between a lower end of the lower shaft part of the spinning shaft and a top end of an inner connector for leading the inner connector and the lower end of the lower shaft part of the spinning shaft to be brought into contact at first for prevention of bending of the shaft when the washing machine is dropped during shipment, or given an impact in other occasions.

32. A full automatic washing machine as claimed in claim 24, wherein the washing shaft has a step in a lower part thereof, and an inner connector has a step fit to the step on the washing shaft in an inside circumferential surface thereof for defining a fastening position when the connector is coupled to the lower part of the washing shaft and fastened with a nut.

33. A full automatic washing machine as claimed in claim 32, wherein the gap between an inner connector and the spinning shaft is formed smaller than a gap between a ball bearing supporting a lower part of the washing shaft in a radial direction and a C-ring.

34. A full automatic washing machine as claimed in claim 32, further comprising a sealing member in the upper part of the washing shaft for prevention of infiltration of water between the washing shaft and the spinning shaft.

35. A full automatic washing machine as claimed in claim 34, wherein the sealing member has at least three lips provided at an inside thereof for securing a sealing reliability.

36. A full automatic washing machine as claimed in claim 24, wherein of the coupling includes;

a flange part in an upper part of a cylindrical body thereof extended in a radial direction, gear teeth at an edge of a top surface of the flange part along a circumference thereof for engagement with the gear teeth of the coupling stopper, and serrations in an inside surface thereof for engagement with the serration in the spinning shaft, and the serration in the outside circumferential surface of the upper part of the inner connector of the connector assembly.

37. A full automatic washing machine as claimed in claim 36, wherein the coupling includes a plurality of projections from a lower end of a body along a circumference thereof.

38. A full automatic washing machine as claimed in claim 18, wherein the plunger, to be inserted in the mover, has a radial direction projection from an outside circumference of an upper part thereof, for prevention of the falling off of the plunger from the mover, as a lower end of a projection is caught at a lower end of a guide long hole in the mover even if the mover is pushed upward by a restoring force of the buffer spring.

39. A full automatic washing machine as claimed in claim 38, wherein the mover includes:

guide ribs on an outside circumferential surface thereof each extended along an axis direction, and the lever guide, the mover is to be inserted therein, includes guide grooves in an inside circumferential surface of a guide part formed to fit to the guide ribs for guiding linear movement of the mover.

40. A full automatic washing machine as claimed in claim 38, wherein the mover has a sloped surface at a top part thereof in correspondence to the sloped surface of the lever, for making the mover to move in a vertical direction when the lever moves in a horizontal direction.

41. A full automatic washing machine as claimed in claim 38, wherein the range of angle of the cam groove is 180 degrees to 210 degrees.

42. A full automatic washing machine as claimed in claim 18, wherein the mover includes:

guide ribs on an outside circumferential surface thereof each extended along an axis direction, and the lever guide, the mover is to be inserted therein, includes guide grooves in an inside circumferential surface of a guide part formed to fit to the guide ribs for guiding linear movement of the mover.

43. A full automatic washing machine as claimed in claim 18, wherein the mover has a sloped surface at a top part thereof in correspondence to the sloped surface of the lever, for making the mover to move in a vertical direction when the lever moves in a horizontal direction.

44. A full automatic washing machine as claimed in claim 18, wherein the return spring has one end in a form of a hook for hooking a hooking projection of the lever, and the other end wound to a larger diameter for being caught at a rear end of the lever guide, and thereby fixing a position of the return spring.

45. A full automatic washing machine as claimed in claim 18, wherein the connecting rod has one end coupled with the cam, and the other end hinge coupled with the lever, and the lever has a stopper at a bottom of one end of the lever, the connecting rod is coupled thereto, for defining an insertion position of the lever in the lever guide when a restoration force of the return spring is applied thereto.

46. A full automatic washing machine as claimed in claim 18, further comprising a compression spring between the top surface of the coupling and the lower shaft holding bearing, for pushing the coupling downward in switching to a spinning mode.

47. A full automatic washing machine as claimed in claim 18, wherein the coupling stopper has a projection from an outer side thereof to be positioned between the plunger and the support bracket of the coupling stopper, the movable rod has a connecting part on the fork form thereof right under the projection for connecting both rods in a transverse direction, and there is an elastic member between the projection and the connecting part for providing a rotation force so that the movable rod rotates in a clockwise direction around the fixed pin.

48. A full automatic washing machine as claimed in claim 47, wherein the elastic member is a tension spring.

49. A full automatic washing machine as claimed in claim 18, wherein the cam of the clutch motor is coupled with the driving shaft directly, for rotation at an angular speed the same with the driving shaft.

50. A full automatic washing machine as claimed in claim 49, wherein the cam has a cam groove within a range of angle in an outside circumferential surface thereof.

51. A full automatic washing machine as claimed in claim 50, wherein the range of angle of the cam groove is 90 degrees to 250 degrees.

52. A full automatic washing machine as claimed in claim 50, wherein the range of angle of the cam groove is 180 degrees to 210 degrees.

53. A full automatic washing machine as claimed in claim 1, further comprising a sealing member in an upper part of the washing shaft for prevention of infiltration of water between the washing shaft and the spinning shaft.

54. A full automatic washing machine as claimed in claim 53, wherein the sealing member has at least three lips provided at an inside thereof for securing a sealing reliability.

55. A full automatic washing machine as claimed in claim 53, wherein serrations in the inside surface of a body of the coupling have pitches formed to have modules different from each other when the serrations are called as an upper serration and a lower serration with reference to a top of the inner connector at a time the coupling moves down fully, and engages with the inner connector.

56. A full automatic washing machine as claimed in claim 55, wherein the pitches of the serrations in the inside surface of a body of the coupling are made such that the module of the serration positioned in a lower part with reference to the top of the inner connector when engaged is greater.

57. A full automatic washing machine as claimed in claim 56, wherein a module ratio of the serration in the upper part of the inside of the body of the coupling to the serration in a lower part thereof is 1:1.5.

58. A full automatic washing machine as claimed in claim 56, wherein, of the serrations in the inside circumferential surface of the body of the coupling, lower ends of the serration in the lower side having a greater pitch are rounded for easy engagement/disengagement with the serration in the inner connector.

59. A full automatic washing machine as claimed in claim 58, wherein the lower ends of the lower side serration are rounded to be involute profile surfaces for easy clutching with the serration of the inner connector.

60. A full automatic washing machine as claimed in claim 56, wherein a region lower ends of the upper side serration and bottom lands of the lower side serration are met therein is rounded to reduce rapid sectional area transition for increasing a strength against a torsional stress.

61. A full automatic washing machine as claimed in claim 55, wherein a module ratio of the serration in the upper part of the inside of the body of the coupling to the serration in a lower part thereof is 1:1.5.

62. A full automatic washing machine as claimed in claim 55, wherein, of the serrations in the inside circumferential surface of the body of the coupling, lower ends of the serration in the lower side having a greater pitch are rounded for easy engagement/disengagement with the serration in the inner connector.

63. A full automatic washing machine as claimed in claim 62, wherein the lower ends of the lower side serration are rounded to be involute profile surfaces for easy clutching with the serration of the inner connector.

64. A full automatic washing machine as claimed in claim 55, wherein a region lower ends of the upper side serration and bottom lands of the lower side serration are met therein is rounded to reduce rapid sectional area transition for increasing a strength against a torsional stress.

65. A full automatic washing machine as claimed in claim 1, further comprising a sealing member in an upper part of an upper shaft holding bearing which holds the spinning shaft for sealing between the spinning shaft and the shaft holding bearing case, the sealing member having at least four lips fitted to an inside thereof and at least three lips fitted to an outside thereof.

* * * * *